US010435912B2

(12) United States Patent
Jensen

(10) Patent No.: US 10,435,912 B2
(45) Date of Patent: Oct. 8, 2019

(54) KIT OF PARTS FOR BUILDING A SUPPORT BASE FOR A POLE-LIKE ELEMENT

(71) Applicant: Plinthit ApS, Aarhus N (DK)

(72) Inventor: Arne Flemming Jensen, Højbjerg (DK)

(73) Assignee: Plinthit ApS, Aarhus N (DK)

( * ) Notice: Subject to any disclaimer, the term of this patent is extended or adjusted under 35 U.S.C. 154(b) by 0 days.

(21) Appl. No.: 15/543,274

(22) PCT Filed: Jan. 12, 2016

(86) PCT No.: PCT/DK2016/050007

§ 371 (c)(1),
(2) Date: Jul. 13, 2017

(87) PCT Pub. No.: WO2016/112917

PCT Pub. Date: Jul. 21, 2016

(65) Prior Publication Data

US 2018/0002943 A1 Jan. 4, 2018

(30) Foreign Application Priority Data

Jan. 13, 2015 (DK) ..... 2015 70011

(51) Int. Cl.
*A47G 33/12* (2006.01)
*E04H 12/22* (2006.01)
(Continued)

(52) U.S. Cl.
CPC ..... *E04H 12/2238* (2013.01); *A45B 25/00* (2013.01); *A45F 3/24* (2013.01); *A47G 33/12* (2013.01); *A63B 61/02* (2013.01); *E04H 12/2276* (2013.01); *A45B 2023/0012* (2013.01); *A45B 2025/003* (2013.01); *A47G 2033/1266* (2013.01)

(58) Field of Classification Search
USPC ..... 248/529
See application file for complete search history.

(56) References Cited

U.S. PATENT DOCUMENTS 830,671 A * 9/1906 Neff ..... A47G 33/12 248/523
1,695,275 A * 12/1928 Davis ..... A47G 33/12 248/523

(Continued)

FOREIGN PATENT DOCUMENTS

| | | | |
|---|---|---|---|
| DE | 3537362 | A1 | 4/1987 |
| NO | 20120442 | A1 | 10/2013 |
| WO | 2008066396 | A1 | 6/2008 |

*Primary Examiner* — Monica E Millner
(74) *Attorney, Agent, or Firm* — James Creighton Wray

(57) ABSTRACT

The invention relates to a kit of parts (100) for building a support base (1) for a pole-like element (2), wherein the kit of parts (100) comprises at least three substantially L-shaped elements (3), each L-shaped element (3) being arranged with an upright part (3A) extending along a body portion (101) of the pole-like element (2) in a direction parallel to a longitudinal axis (z) of the pole-like element (2) and with a foot part (3C) extending outwardly from a lowermost portion (102) of the pole-like element (2), wherein the kit of parts (100) further comprises a first holding means for holding a substantially right-angled part (3B) of each L-shaped element (3) in proximity of the lowermost portion (102) of the pole-like element (2).

12 Claims, 24 Drawing Sheets

(51) Int. Cl.

| | |
|---|---|
| ***A45B 25/00*** | (2006.01) |
| ***A45F 3/24*** | (2006.01) |
| ***A63B 61/02*** | (2006.01) |
| *A45B 23/00* | (2006.01) |

(56) References Cited

U.S. PATENT DOCUMENTS

| | | | | | |
|---|---|---|---|---|---|
| 2,250,361 | A * | 7/1941 | Cullinan | A47G 7/025 | 248/146 |
| 2,485,081 | A * | 10/1949 | Abrens | A47G 33/12 | 248/524 |
| 3,045,959 | A * | 7/1962 | Herrington | A47G 33/1206 | 248/526 |
| 3,655,156 | A * | 4/1972 | Petrie | A47G 33/12 | 248/188.7 |
| 3,733,040 | A * | 5/1973 | Rocquin | A47G 33/12 | 248/174 |
| 4,007,901 | A | 2/1977 | Mancini | | |
| 4,801,123 | A * | 1/1989 | Lynch | A47G 33/12 | 248/150 |
| 5,195,715 | A * | 3/1993 | Cone | F16M 11/42 | 248/526 |
| 5,673,893 | A * | 10/1997 | Klein | A47G 33/1206 | 248/525 |
| 7,597,304 | B1 | 10/2009 | Gray | | |
| 7,984,884 | B1 * | 7/2011 | Iliev | A47G 33/12 | 248/146 |
| 2003/0084607 | A1 * | 5/2003 | Cone | A47G 33/1206 | 47/40.5 |
| 2014/0151526 | A1 * | 6/2014 | Duncan | A47G 33/12 | 248/523 |

* cited by examiner (A)

(B)

(C)

(A)

(B)

(A)

(B)

(C)

KIT OF PARTS FOR BUILDING A SUPPORT BASE FOR A POLE-LIKE ELEMENT

This application claims the benefit of Danish Application No. PA 2015 70011 filed Jan. 13, 2015, Danish Application No. PA 2015 70357 filed Jun. 10, 2015 and PCT/DK2016/050007 filed Jan. 12, 2016, International Publication No. WO 2016/112917 A1, which are hereby incorporated by reference in their entirety as if fully set forth herein.

FIELD OF THE INVENTION

The invention relates to the technical field of assemblies for building support bases, particularly to support bases for pole-like elements.

BACKGROUND OF THE INVENTION

Typical support bases for pole-like elements such as garden umbrellas or Christmas trees are made in a variety of manners, but all of them have in common the disadvantage of not being able to accommodate any size of umbrella/tree and/or not being able to hold the umbrella/tree upright. Moreover, most of the known solutions are already assembled, which makes it difficult to transport and store.

U.S. Pat. No. 7,597,304 disclose a support base for an upright member, such as for example a Christmas tree, where the support base comprises a heavy base member, having a central aperture. Further two brackets having bent plate sections shaped to engage a part of the outer rounded surface of the upright member, and stabilizing bars extending radially from said plate sections is provided. In use the rounded bent plate sections are arranged around the upright member. The assembly is arranged inside the central aperture in the heavy base member. In order to maintain the two brackets in engagement with the upright a strap is arranged and tightened around the bent plate sections, such that the brackets are maintained in firm engagement with the upright member, and the stabilizing bars engagement with the heavy base member provides the stability.

From DE 3537362 is disclosed a support base for an upright member, such as a Christmas tree. The preamble of independent claim 1 of the present invention is based on this document. Which disclose a kit of parts for building a support base for in use supporting a pole-like element (in this instance a Christmas tree) in an upright position, the kit of parts comprises at least three substantially L-shaped elements, each L-shaped element having three integral sections; an upright part suitable to extend along a body portion of the pole-like element in a direction parallel to a longitudinal axis of the pole-like element and a foot part connected to said upright part by means of a right-angled part, such that the foot part in use extends outwardly from a lowermost portion of the pole-like element, wherein the kit of parts further comprises a first holding means for holding and urging each L-shaped element towards the pole-like element.

Hence, there is a need in the technical field of assemblies for building support bases for pole-like elements of overcoming the aforementioned drawbacks of the state-of-the-art solutions.

ASPECTS OF THE INVENTION

The first aspect of the invention is to provide an improvement to the state-of-the-art. The second aspect of the invention is to solve the aforementioned drawbacks of the prior art by providing a solution, which applies to any size of pole-like element, which maintains the pole-like element stably upright, which is easy to transport, and which is easy and quick to assemble and store.

The invention consequently provides a multifunctional solution to a pole support base, which by its construction comprising very few parts, provide excellent support properties in use and when not in use may be disassembled and take up very little space in storage.

In the embodiments presented of the invention various constructions comprising the basic principle of the invention, may be modified such that all types of poles spanning from simple small flag poles (the invention without the upper ring) to larger poles exposed to substantial horizontal forces, i.e. parasols, larger masts etc. (including the upper ring clamping the distal ends of the L-shaped members towards the pole).

DESCRIPTION OF THE INVENTION

The aforementioned aspects of the invention are achieved by a kit of parts for building a support base for a pole-like element wherein the kit of parts further comprises a base element (4) having a centre portion (6) to be placed underneath the pole-like element (2) is provided, the base element (4) including either:

- a number of channels (5) extending radially from said centre portion (6) of the base element (4), wherein each channel (5) is formed such as to accommodate at least a portion of the right-angled part (3B) of a L-shaped element (3); or
- a number of projections (12) extending radially from said centre portion (6) of the base element (4), wherein each projection (12) comprises at a free-end a first element of a fastening means for engaging with a second element of the fastening means, said second element being arranged at the right-angled part (3B) of each L-shaped element (3).

When building the support base, the L-shaped elements are brought into contact with the body portion of the pole-like element. As a consequence, the support base can be built around the pole-like element, thus being able to accommodate any size of pole-like element. Moreover, holding the right-angled parts of the L-shaped elements close to the pole-like element provides a larger base for the pole-like element, thus enabling holding the pole-like element stably upright. In fact, thanks to a larger base, the L-shaped elements exert a stronger opposing force to the pole-like element with respect to a solution where the L-shaped elements are held loosely or at a distance from the pole-like element. Finally, the support base is more easily transportable as it is composed by several parts, which can be more smartly packaged than a fixed large support base.

The base element having a centre portion (e.g., a round plate, a triangular plate, etc.), is provided, said base element to be placed underneath the pole-like element (e.g., a plate with a centre portion having the same area as the bottom side of the pole-like element), the base element including a number of channels extending radially from said centre portion of the base element (and, e.g., ending at a perimeter of the base element), wherein each channel is formed such as to accommodate at least a portion of the right-angled part of an L-shaped element. By being accommodated in the channels of the base element, the right-angled parts of the L-shaped elements are orientated in specific directions instead of being placed, for example, randomly around the pole-like element. This has the advantage of better balancing the support base instead of concentrating counter forces, for example, in a single direction.

Advantageously, three L-shaped elements are arranged at an angle of 120 degrees between each L-shaped element. Advantageously, four L-shaped elements are arranged at an angle of 90 degrees between each L-shaped element. By increasing the number of L-shaped elements the support base is more firmly balanced, since a force equal and opposed to a force exerted in a certain direction (e.g., by the wind) will be countered by one or more of the L-shaped elements. Consequently, the pole-like element will be held firmly and stably upright.

In an advantageous embodiment of the invention, each channel has inwardly-tapered lateral sides and each portion of the right-angled part of an L-shaped element has a cross-section with a shape and dimension suitable to engage with the channel (e.g., a trapezoidal cross-section having a dimension such that when the engaging portion is inserted in the channel, the engaging portion does not slip away from the channel but remains firmly in place inside the channel). The synergistic effect of the combination of the inwardly-tapered lateral sides of the channel and the cross-section of the engaging portion is to avoid that the portion of the right-angled part of the L-shaped element escapes from the channel but remains firmly in place close to the centre portion of the base element, i.e., close to the lowermost portion of the pole-like element.

In an advantageous embodiment of the invention, at least one lateral side (e.g., one or both) of each channel comprises a flange (e.g., extending in the same plane as the base element from the centre portion of the base element to the perimeter of the base element) and each portion of the right-angled part of an L-shaped element has an opening with a shape and dimension suitable to engage with the flange (e.g., an opening to a cavity having dimensions matching the cross-section of the flange and a depth matching the length of the flange). The synergistic effect of the combination of the flange in the channel and the opening in the portion of the right-angled part of the L-shaped element is to secure the right-angled part of the L-shaped element to the base element, thereby avoiding that the former disengages from the latter but remains firmly in place close to the lowermost portion of the pole-like element. Furthermore, the flange and the opening also help the L-shaped element remaining in its position relative to the base element.

Advantageously, the base element and the L-shaped elements may be a combination of the previous two embodiments.

In an advantageous embodiment of the invention, the portion of the right-angled part of an L-shaped element is provided underneath (e.g., at a boundary between the right-angled part and the foot part of the L-shaped element) with a cutout corresponding in dimension to a thickness of the base element. As a consequence, the foot part entirely rests on the ground; therefore, the underside of the L-shaped elements is fully supported, partly on the base element and partly on the ground.

In a further advantageous embodiment of the invention, a base element having a centre portion to be placed underneath the pole-like element is provided, the base element including a number of projections (e.g., pairs of parallel projections) extending radially (e.g., at 90 degrees from one another) from said centre portion of the base element, wherein each projection comprises at a free-end a first element of a fastening means for engaging with a second element of the fastening means, said second element being arranged at the right-angled part of each L-shaped element. Thanks to the provision of the first element at the base element and the second element at the right-angled part of the L-shaped element, the right-angled parts are held close to the lowermost portion of the pole-like element.

Advantageously, the first element is an eye (e.g., formed by the hole in-between two projections in a pair of projections and a pin attached transversally at the free-ends of the two projections) and the second element is a hook. The hook engages with the eye so that the right-angled parts are held in proximity of the lowermost portion of the pole-like element.

Advantageously, the first element is a cylindrical element extending perpendicularly to a plane defined by the base element and the second element is an opening suitable to accommodate said cylindrical element. For example, the base element may have the shape of a cross and may comprise a solid or hollow cylindrical element at each free-end. By inserting the cylindrical elements into the openings, the right-angled parts are held close to the lowermost portion of the pole-like element.

Advantageously, the cylindrical element and the opening have matching threaded portions. Thereby, the cylindrical element can be screwed into the opening. Advantageously, the opening is a hole and the cylindrical element has a threaded portion, where a nut is used to tighten the right-angled part to the base element by screwing the nut onto the cylindrical element. Advantageously, the opening has a shape and dimensions such that the cylindrical element can be press-fitted or clicked into the opening. Thereby, the threaded portions at the cylindrical element and the opening as well as the nut can be avoided.

Advantageously, each cylindrical element is adjustable along each projection of the base element. Hence, the base element, and consequently the support base, is able to accommodate any size of pole-like element.

Advantageously, the first and second elements are matching holes, wherein a third element (e.g., comprising a bolt and a nut) is used to fasten the projections of the base element to the right-angled parts of the L-shaped elements.

In an advantageous embodiment of the invention, the first holding means is a first ring member adapted to encircle and hold the right-angled parts of the L-shaped elements in proximity of the lowermost portion of the pole-like element.

Advantageously, the first ring member may also be used in combination with the aforementioned first holding means.

Advantageously, the first ring member has a number of cutouts formed such that the right-angled part of each L-shaped element can pass through the first ring member while the first ring member can stand on the ground. Consequently, the first ring member, while remaining tightened to the right-angled parts, has several portions contacting the ground, thus providing a more stable base to the support base.

In an advantageous embodiment of the invention, the kit of parts further comprises a second holding means for holding the upright part of each L-shaped element tight to the body portion of the pole-like element. By holding the upright parts close to the body of the pole-like element, the latter does not slip away in-between two upright parts eventually tipping over such as in case of wind.

In an advantageous embodiment of the invention, the second holding means is a second ring member adapted to encircle and to hold the upright parts of the L-shaped elements tight to the body portion of the pole-like element.

Advantageously, the first ring member and/or the second ring member have a shape (e.g., circular, triangular or square) and dimension suitable for encircling and holding the right-angled parts of the L-shaped elements in proximity of the lowermost portion of the pole-like element.

Advantageously, the first ring member and/or the second ring member comprise a number of recesses (e.g., radially opposing) on an inner face of the first ring member and the second ring member, respectively. Advantageously, the recesses may be dimensioned such as to accommodate the L-shaped elements, e.g., by having a width and a depth corresponding to the cross-section of the right-angled/upright parts of the L-shaped elements. Thanks to the recesses, the inner face of the first/second ring member is always in contact either with the pole-like element or with the right-angled/upright parts of the L-shaped elements, thus providing an optimal grip to the first/second ring member.

Advantageously, the first ring member and/or the second ring member comprise a means for loosening and tightening the first ring member and the second ring member, respectively. Thus, the first/second ring member can be more easily mounted around the right-angled/upright parts of the L-shaped elements and tightened as much as desired.

Advantageously, the first ring member and/or the second ring member are clamps, wherein each clamp comprises a number of clamping elements (e.g., radially opposing) and a fastening means (e.g., bolts and barrel nuts) for fastening adjacent clamping elements. For example, by tightening the barrel nuts on the bolts, the clamping elements are forced towards the center of the first/second ring member. As a consequence, the right-angled/upright parts are pressed onto the pole-like element, thus providing a means for loosening and tightening the first/second ring member.

Advantageously, each clamping element includes a friction-generating portion (e.g., a knurling with a straight pattern) arranged to face inwardly towards a centre of the clamp. A higher friction is thereby generated between the clamp and the right-angled/upright parts of the L-shaped elements so that the clamp can be firmly mounted without losing its grip.

Advantageously, the first ring member and/or the second ring member comprise radially opposing bolts operable to be screwed against the right-angle parts and the upright parts, respectively (and/or against the pole-like element). Consequently, the right-angled/upright parts are pressed onto the pole-like element, thus providing a means for loosening and tightening the first/second ring member and enabling receiving pole-like elements of any size.

Advantageously, each upright part includes one or more indentations along the longitudinal axis for engaging with the bolts. Since the bolts engage with the indentations, the upright parts of the L-shaped elements are pushed against and held in tight contact with the pole-like element.

Advantageously, the first ring member and/or the second ring member comprise a number of magnets (e.g., radially opposing) on an inner face of the first ring member and the second ring member, respectively (e.g., attached to the inner face of the first/second ring member; integrated in the first/second ring member and being visible at the bottom of a recess or at the inner face of the first/second ring member, etc.), wherein at least a contact portion (i.e., the portion in contact with the magnet) of each right-angled part and/or upright part is made of a magnetic material. This embodiment has the advantage that the first/second ring member can be held in position while the pole-like element is being mounted and can be attached more tightly to the L-shaped elements.

Advantageously, the first ring member and/or the second ring member comprise a means for opening and closing the first ring member and the second ring member, respectively. Hence, the first/second ring member can be more easily mounted around the right-angled/upright parts of the L-shaped elements.

Advantageously, the whole ring member is a magnet. This can be beneficial, for example, in case the pole-like element is made of a magnetic material so that the first/second ring member can be tightly attached to the pole-like element and the right-angled/upright parts of the L-shaped elements. Also, the first/second ring member can be held in position while the pole-like element is being mounted.

Advantageously, the first holding means and/or the second holding means are straps (e.g., Velcro straps). The L-shaped elements are placed in contact with the pole-like element and are fastened and tightened to the pole-like element at the right-angled and/or upright parts by the straps. Thereby, a pressure is exerted from the L-shaped elements towards the pole-like element and the foot parts act as a base for the pole-like element.

Advantageously, the first holding means and/or the second holding means are cable ties. A cable tie can be loosened and tightened around the right-angled/upright parts of the L-shaped elements.

Advantageously, the kit of parts further comprises at least one weight (e.g., a sack filled with sand, cement, aggregate, etc., and combinations thereof) adapted to be positioned on the foot part of one or more L-shaped elements. The weight supplies a gravitational force exerted onto the foot parts of the L-shaped elements that can counteract the force transferred by the pole-like element to the right-angled and upright parts of the L-shaped element.

Advantageously, the foot part is solid and made of a material comprising sand, cement, aggregate, and combinations thereof. The foot part may therefore act as a weight without the need for a standalone weight to be placed over it. Nevertheless, a standalone weight may also be used in combination with such a foot part in order to provide an even higher weight and thus even more stability to the support base.

Advantageously, the base element and/or the L-shaped elements include a ground spike underneath (e.g., a ground spike may be placed underneath the centre of the base element and underneath the free-end of each foot part). As a consequence, the support base can be fixed in the ground (e.g., grass or sand).

Advantageously, one or more foot parts extend longer (e.g., two or three times the length) than the other foot parts. In case the pole-like element may tip over in a certain direction, for example, due to a heavy weight (e.g., a hammock) or the wind, a longer footprint can counterbalance such a pressure.

Advantageously, an extension element is connectable to the foot part. As a consequence, the foot part of the L-shaped element can be more easily extended and packaged without the need for carrying around a cumbersome foot part.

Advantageously, one or more foot parts comprise a shaft part and a blade part (e.g., having the same shape of the terminal part of a paddle). The blade part enlarges the footprint of the L-shaped element, thus providing more stability to the support base. Moreover, thanks to the shaft part, the blade part can be connected to the right-angle part of the L-shaped element.

Advantageously, an element comprising a shaft part and a blade part is connectable to the foot part or the extension element (e.g., through an insertion channel onto the blade part or by means a press-fit between a hollow part of the blade part and the foot part or the extension element). As a consequence, the foot part of the L-shaped element can be more easily packaged without the need for carrying around a cumbersome foot part.

In an advantageous embodiment of the invention, each upright part of each L-shaped element gradually tapers towards the free-end of the upright part. Since the thickness of the upright part of the L-shaped elements gradually increases towards the right-angled part, the lower the first/second ring member sits the closer the L-shaped elements are pressed together and the higher is the radial pressure onto the pole-like element. As a consequence, it can be adjusted how tight the right-angled/upright parts shall be held against the pole-like element.

In a further advantageous embodiment of the invention the L-shaped elements has a first side face suitable to contact the pole-like element, and an opposite second side face, facing away from the first side face intended for contacting the pole-like element, where the upright part (3A) of the L-shaped element tapers from a free distal end towards the right-angled part (3B), and where the second side face is provided with serrations or ridges or grooves or teeth or barbs.

The serrations or ridges or grooves or teeth or barbs or other suitable features providing the same advantages, are provided in order to greatly increase the friction between the first holding means and the L-shaped member, in practice fixing the first holding means in place relative to the L-shaped members. In this manner the L-shaped members are effectively fixed and urged towards the pole.

In a still further advantageous embodiment the first holding means is in the shape of a ring, where said ring is dimensioned to be placed over the at least three L-shaped members in use, and where said ring is provided with a number of guide grooves corresponding to the number of L-shaped elements, such that each L-shaped element will slidably and releasably be held and guided by said guide groove and also in further embodiments the ring is provided with a slit allowing the ring to expand its diameter, and where means for releasably closing said slit is provided.

The ring shape provides a homogeneous distribution of forces and thereby a substantially even distribution of forces against the pole. The slit makes it possible to expand the inner diameter, thereby releasing the ring from its engagement with the L-shaped elements and thereby the pole.

In a still further advantageous embodiment of the invention the L-shaped elements on the upright part is provided with at least three side faces, a first side face suitable to come into contact with the pole-like element, and two side faces, a second and a third side face extending away from said first side face, where said second and third side faces are provided with corrugations, barbs, serrations, teeth, ridges or grooves, and where the first holding means comprises:

a ring-shaped under-cup, said under-cup having a bottom plate where a central aperture having a first diameter is provided in said bottom plate, and where a peripheral wall is provided around an outer perimeter of said bottom plate, said central aperture being provided with at least three guide grooves, and that adjacent at least one guide groove two release taps are projecting up from the bottom plate in the same direction as the peripheral wall, such that one release tap is arranged on either side of the guide groove, where said release taps are biased towards each other, and where further one or more holding legs are provided on said bottom plate extending in the same direction as the peripheral wall, where said holding legs in a distal end is provided with hook means;

an over-cup, said over-cup having a top plate and a peripheral wall arranged along the outer perimeter of said top plate, where a second central aperture having a second diameter is provided in said top plate, said second diameter being larger than the first diameter, said second central aperture being provided with at least three guide grooves, and where at least one guide groove is provided with flexible engagement means projecting into the guide groove, said engagement means suitable to engage the corrugations, barbs, serrations, teeth, ridges or grooves provided on the upright part of the L-shaped elements, when the L-shaped elements are positioned in the guide grooves, and where one or more flanges are provided extending into the second central aperture, such that when the under-cup is assembled with the over-cup, the release taps are positioned in contact with the engagement means on a side of the engagement means facing the guide grooves, and where the hook means engages the one or more flanges, thereby locking the under-cup and over-cup together, only allowing the under-cup and over-cup to be further compressed, and where biasing means are provided between said over and under-cups, biasing the under-cup away from said over-cup.

As the first holding means in the shape of a ring is slid down the pole and the upright parts of the L-shaped members, the guide grooves will accommodate the upright parts of the L-shaped members. The engagement means will "click" as they are pushed past the serrations (or the like) on the Upright part of the L-shaped members. When the ring is in firm engagement with the L-shaped members the engagement means has effectively engaged the L-shaped members and a firm and stable hold is established for the pole mounted in the center. In order to release the ring, the over and under-cup are further pressed towards each other—against the biasing means. The release members engage the engagement means and releases the hold against the L-shaped members. A simple and inventive manner in which to securely and releasably lock the pole base around the pole.

The invention is also directed at a ring per se, having the features and advantages just described above.

Hereafter, the invention will be described in connection with drawings illustrating non-limiting examples of a kit of parts for building a support base for a pole-like element.

BRIEF DESCRIPTION OF THE DRAWINGS

FIG. 12: A first ring member having cutouts for letting the right-angled parts through.

NOTATIONS x-y: Plane.
z: Longitudinal axis.
1: Support base.
2: Pole-like element.
3: L-shaped element.
3A: Upright part.
3B: Right-angled part.
3C: Foot part.
4: Base element.
5: Channel
6: Centre portion of the base element.
7: Lateral side of a channel
8: Flange.
9: Opening.
10: Cutout.
11: Boundary.
12: Projection.
13: Eye.
14: Hook.
15: Cylindrical element.
16: Cutout.
17: First ring member.
18: Second ring member.
19: Recess.
20: Inner face of the ring member.
21: Clamp.
22: Clamping element.
23', 23": Fastening means.
24: Friction-generating portion.
25: Bolt.
26: Indentation.
27: Magnet.
28: Contact portion.
29: Strap.
30: Ground spike.
31: Extension element.
32: Shaft part.
33: Blade part.
34: Pin.
35: Bolt.
100: Kit of parts.
101: Body portion of the pole-like element.
102: Lowermost portion of the pole-like element.
103: Means for opening and closing the ring member.
104: Umbrella.
105: Tennis net (or windbreaker).
106: Hammock.

Preferred Embodiments of the Invention

Figure 1:
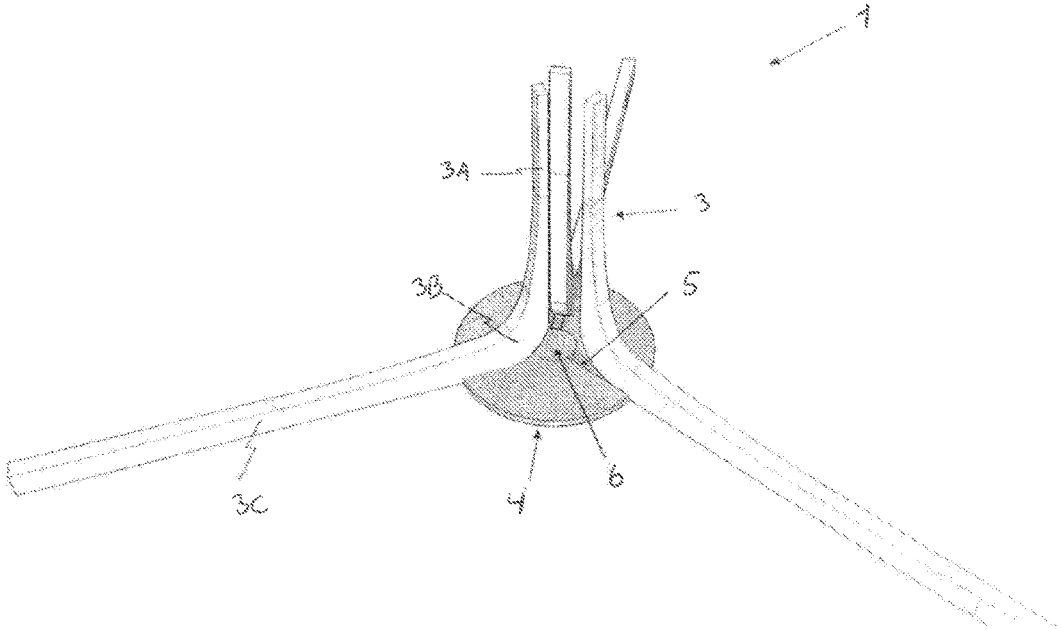
FIG. 1: A support base with a base element comprising channels.

FIG. 1 shows a support base 1 for a pole-like element 2 (ref. FIGS. 2-5) with three L-shaped elements 3 and a base element 4 to be placed underneath the pole-like element 2 (ref. FIGS. 2-5). The base element 4 includes three channels 5 extending radially from a centre portion 6 of the base element 4, wherein each channel 5 is formed such that at least a portion of the right-angled part 3B of an L-shaped element 3 can be inserted in the channel 5. Consequently, the base element 4 holds the right-angled part 3B of each L-shaped element 3 orientated according to a certain direction with respect to the pole-like element 2 (ref. FIGS. 2-5).

Figure 2:
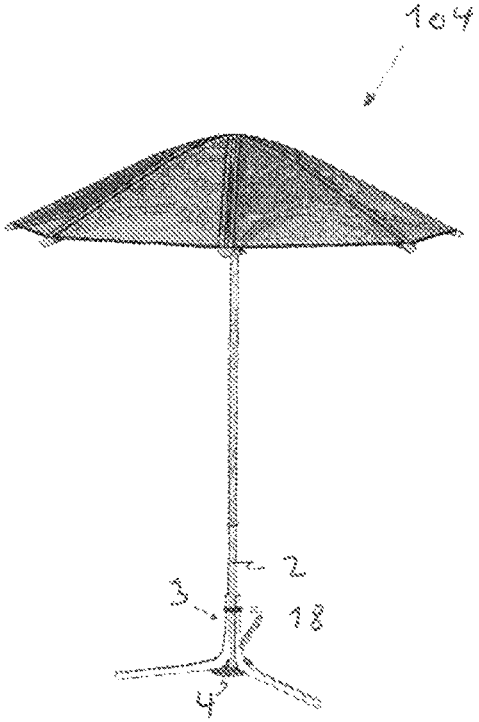
FIG. 2: A support base for a garden umbrella.

FIG. 2 shows the support base 1 in FIG. 1 as a support base for a garden umbrella 104, wherein the three L-shaped elements 3 are arranged with their upright parts 3A extending along a body portion 101 of the pole 2 of the umbrella 104 in a direction parallel to a longitudinal axis z of the pole 2 and with their foot parts 3C extending outwardly from a lowermost portion 102 of the pole 2. In particular, the three foot parts 3C have the same length. Also, a second ring member 18 being a circular ring of a suitable shape and dimension is used for encircling and holding the upright parts 3A of the L-shaped elements 3 tight to the body portion 101 of the pole 2 of the umbrella 104.

Figure 3:
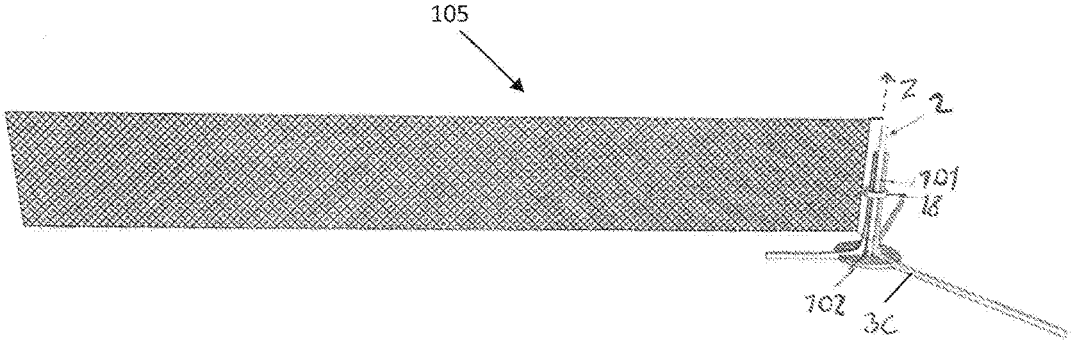
FIG. 3: A support base for a tennis net or windbreaker.

FIG. 3 shows the support base 1 in FIG. 1 as a support base for a tennis net or windbreaker 105. Differently from FIG. 2, the two foot parts 3C extending in directions substantially opposite to the direction of the net or windbreaker 105 are longer than the third foot part 3C.

Figure 4:
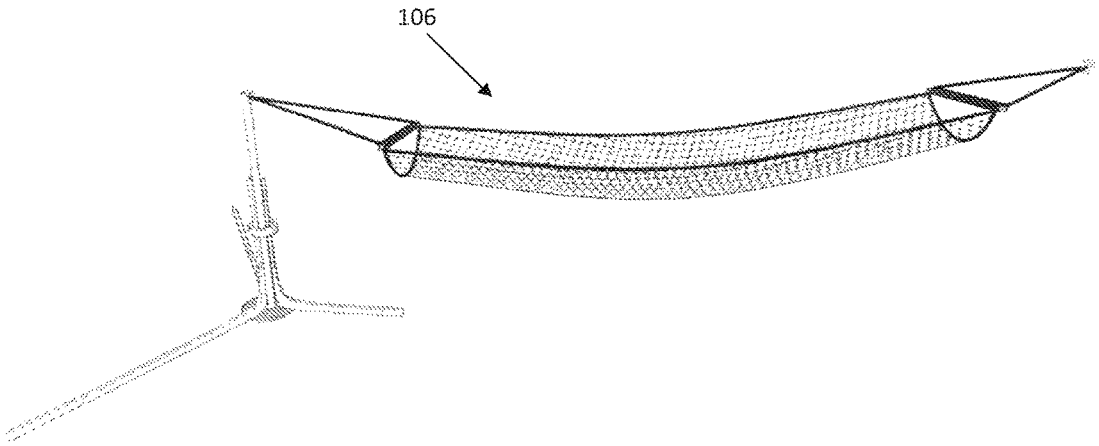
FIG. 4: A support base for a hammock.

FIG. 4 shows the support base 1 in FIG. 3 as a support base for a hammock 106.

Figure 5:
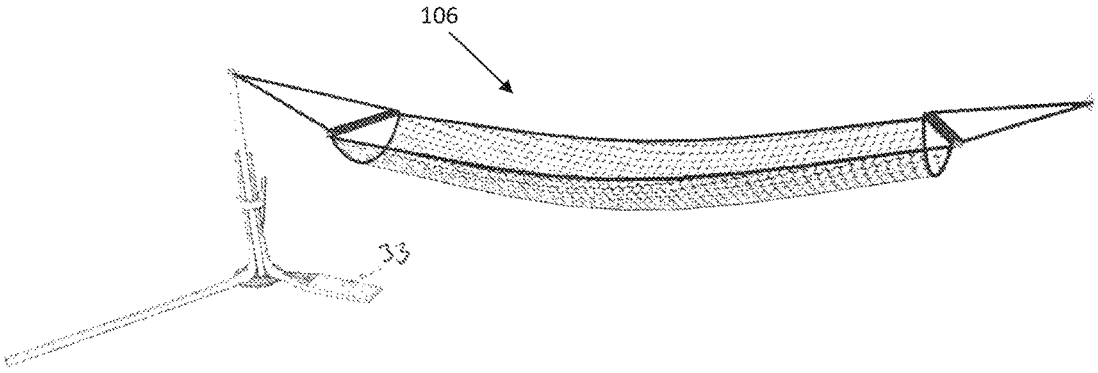
FIG. 5: A support base with a foot part comprising a blade part.

FIG. 5 shows the support base 1 in FIG. 4, wherein one foot part 3C is composed of a blade part 33.

Figure 6:
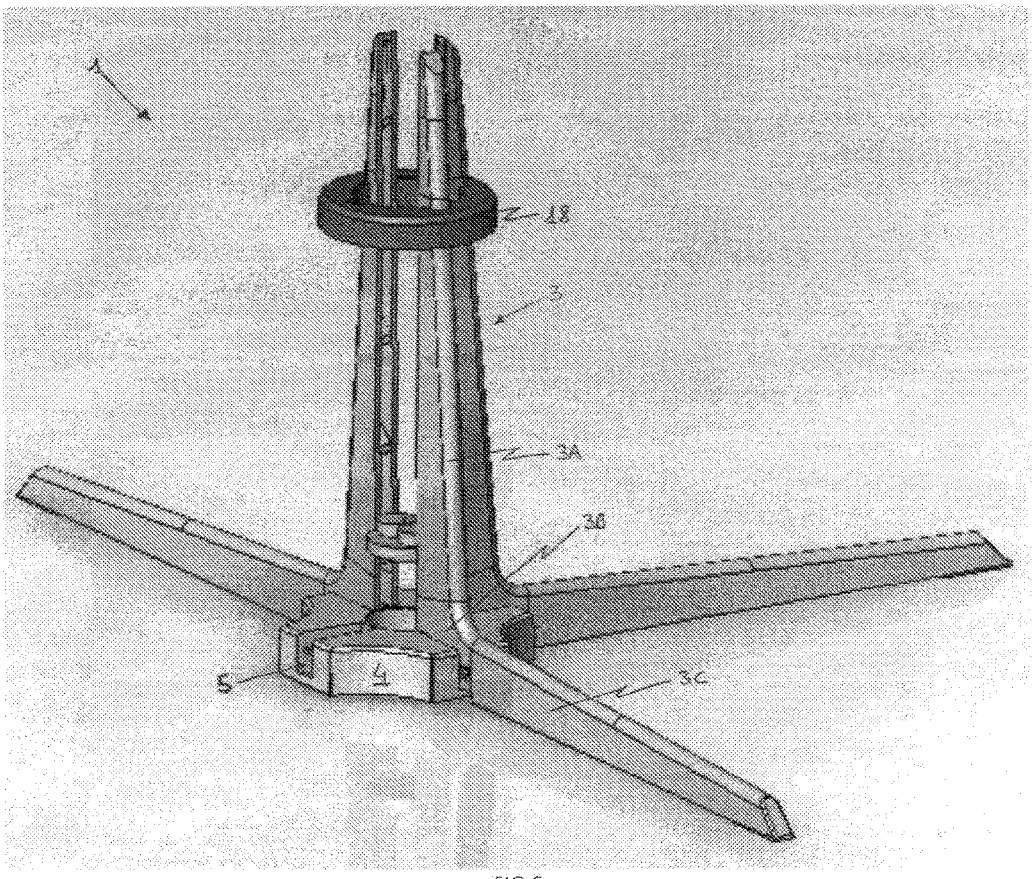
FIG. 6: A support base with a base element with two flanges in each channel.
Figure 7:
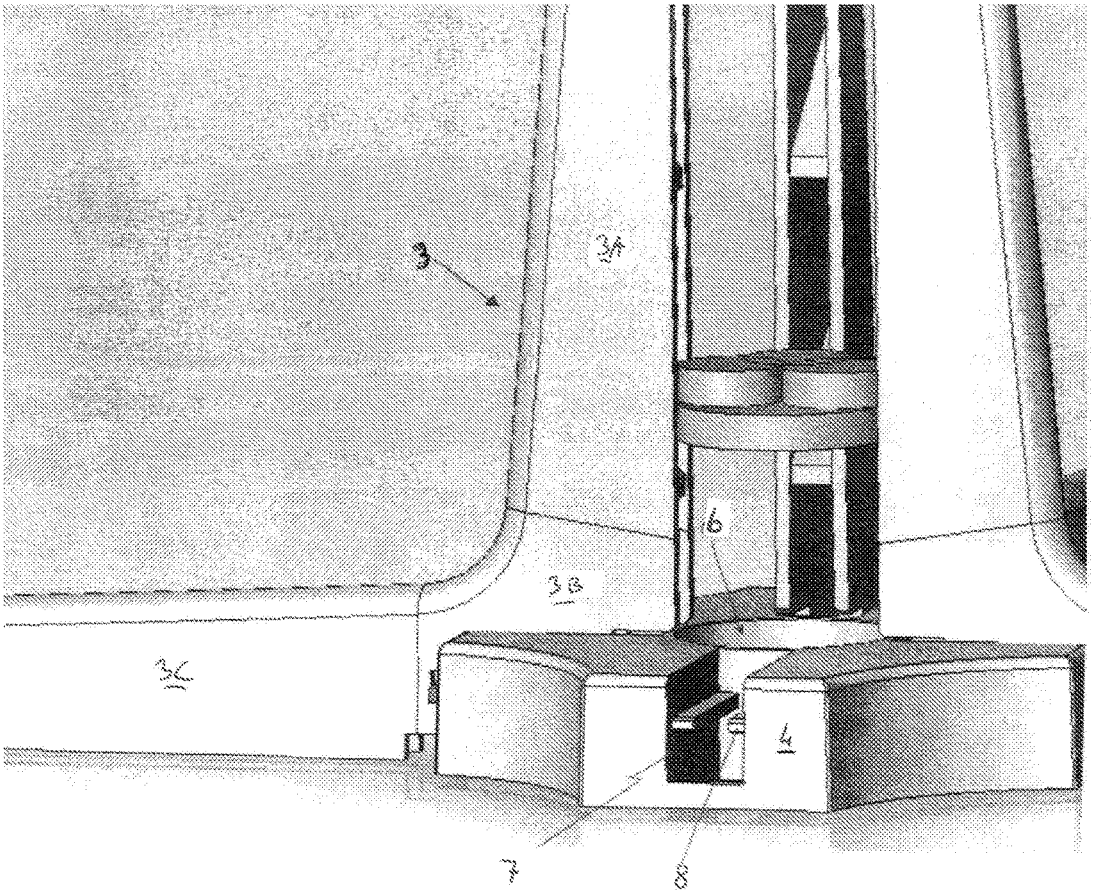
FIG. 7: A close-up view of two flanges in a channel.
Figure 8:
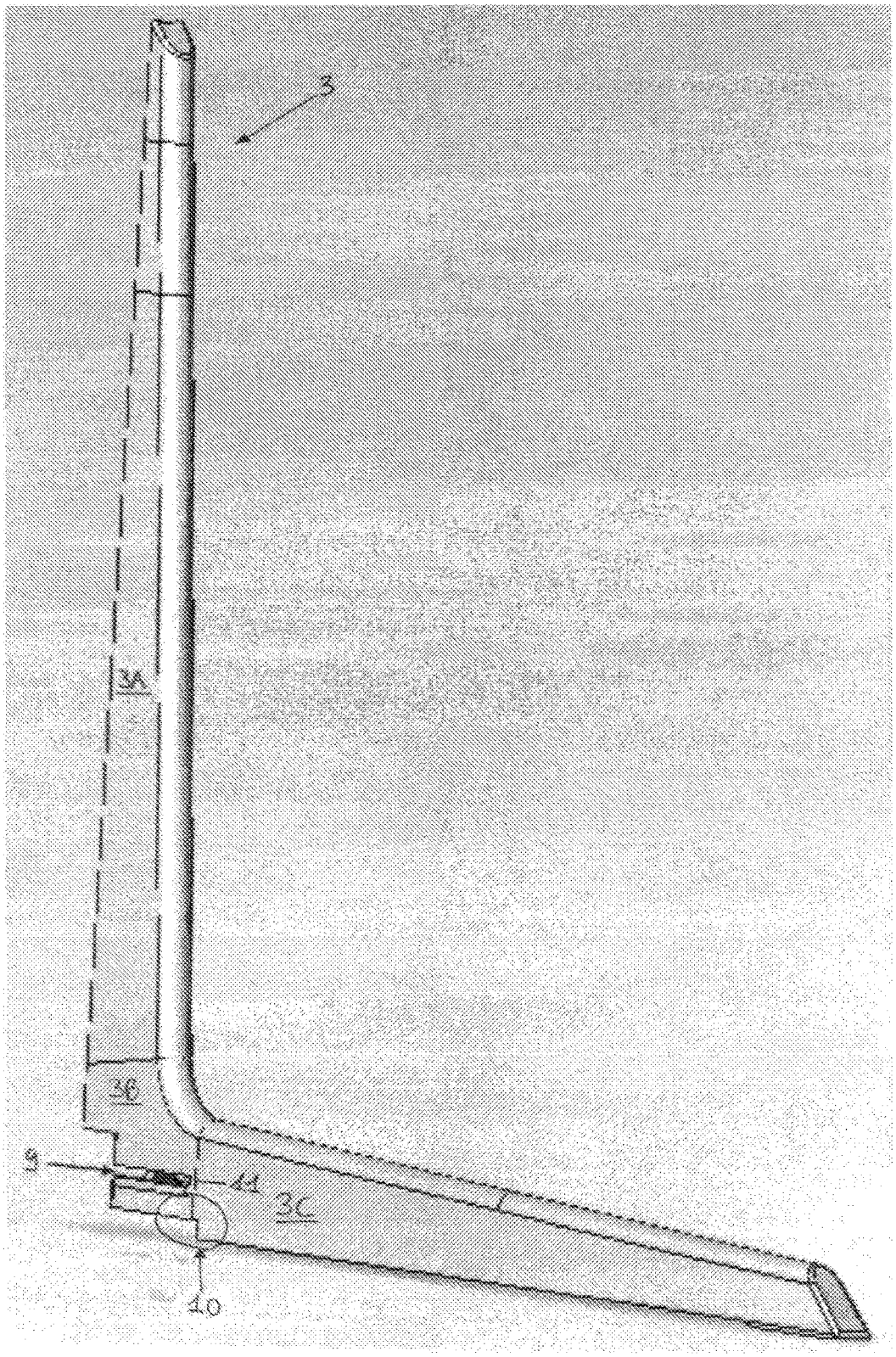
FIG. 8: An L-shaped element with a cutout.

FIG. 6 shows a support base 1 for a pole-like element 2 (not shown in FIG. 6) with three L-shaped elements 3 and a base element 4 to be placed underneath the pole-like element 2. The base element 4 includes four channels 5 extending radially from a centre portion 6 of the base element 4, wherein the lateral sides 7 of each channel 5 comprise a flange 8 (ref. FIG. 7). Each L-shaped element 3 has an opening 9 (ref. FIG. 8) of a shape and dimensions suitable to engage with the flange 8. Also, each L-shaped element 3 has a cutout 10 (ref. FIG. 8) at a boundary 11 between the right-angled part 3B and the foot part 3C.

Figure 9:
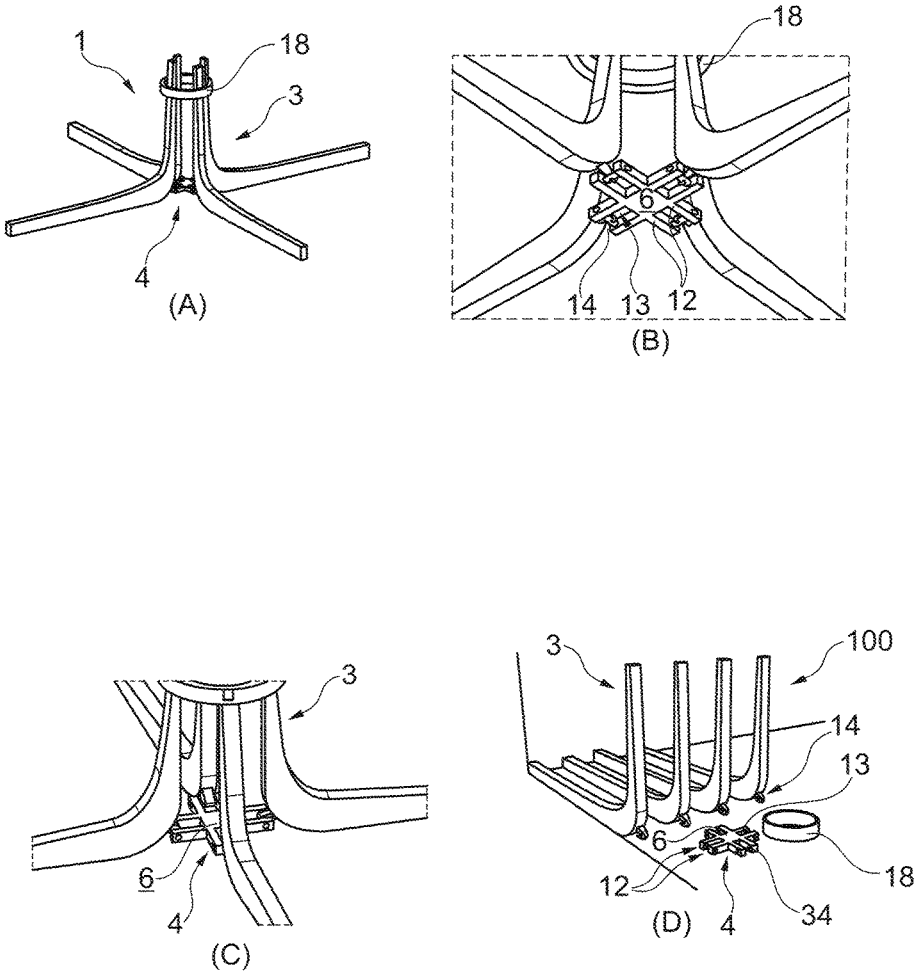
FIG. 9: A kit of parts and a support base with a base element comprising projections.

FIG. 9(D) shows a kit of parts 100 comprising four L-shaped elements 3, a base element 4 and a ring 18. FIGS. 9(A)-(C) show a support base 1 for a pole-like element 2 (not shown in FIG. 9). The base element 4 includes four pairs of parallel projections 12, wherein each pair of projections 12 extends radially from a centre portion 6 of the base element 4 and comprises at a free-end an eye 13 formed by the hole in-between the projections 12 and a pin 34 attached transversally at the free-ends of the projections 12. Also, the right-angled parts 3B of the L-shaped elements 3 comprise a hook 14 on their back sides for engaging with the pin 34 at the base element 4.

Figure 10:
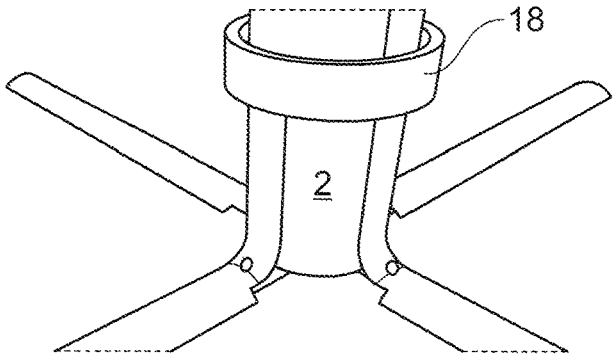
FIG. 10: A support base with a base element comprising cylindrical elements.
Figure 10:
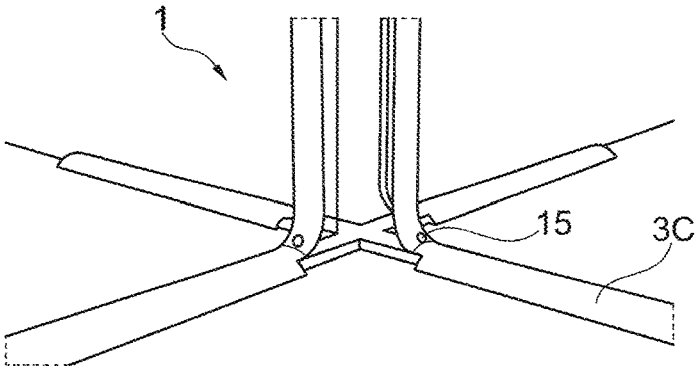
Figure 10:
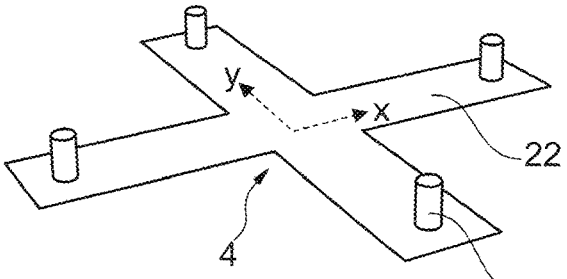
Figure 11:
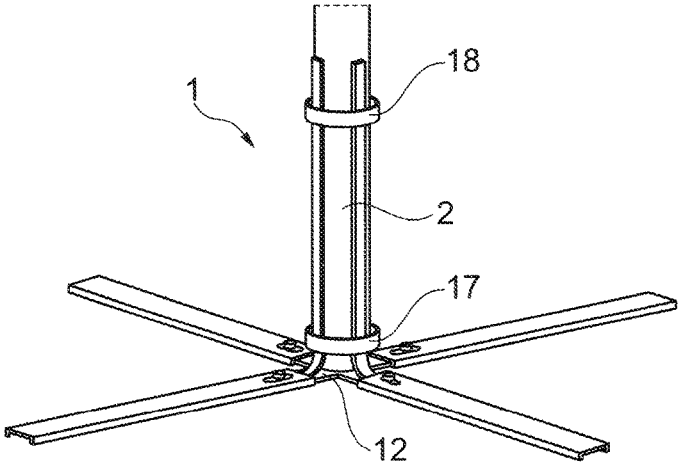
FIG. 11: A support base with two ring members.
Figure 11:
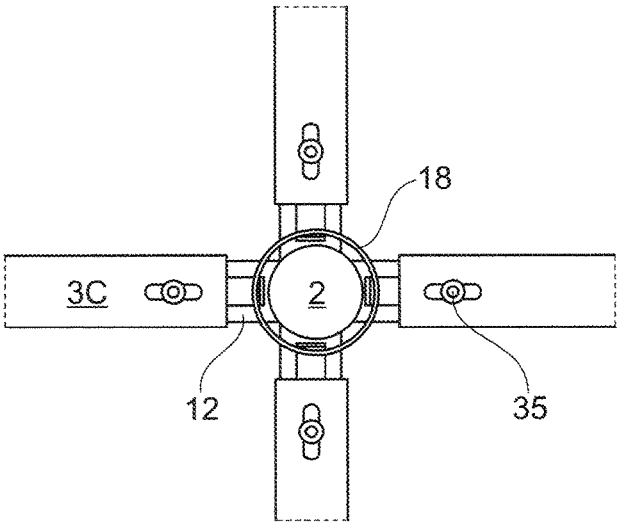

FIG. 10 shows a support base 1 for a pole-like element 2 (FIG. 10(A)). The base element 4 has the shape of a cross with four projections 12, wherein each projection 12 comprises at its free-end a cylindrical element 15 extending perpendicularly to the plane x-y defined by the base element 4 and engaging with a hole at the right-angled part 3B of each L-shaped element 3. In particular, the foot part 3C is larger than the right-angled and upright parts 3A, 3B and may include either a cut-out 10 as in FIG. 8 and/or may surround a projection 12 (ref. FIG. 11) for its entire length, for example, in case the projection 12 extends further than the right-angled part 3B.

FIG. 11 shows a support base 1 for a pole-like element 2 (FIG. 11(A) is a perspective view while FIG. 11(B) is a top view). The support base 1 comprises a first ring member 18 and a second ring member 17 in combination with a cross-shaped base element 4. The foot parts 3C of the L-shaped elements 3 are larger than the right-angled and upright parts 3A, 3B and partly overlap with the projections 12 of the base element 4 to which they are fastened to by means of bolts 35. In particular, the foot parts 3C have a C cross-section adapted to surround the projections 12 of the base element 4.

Figure 12:
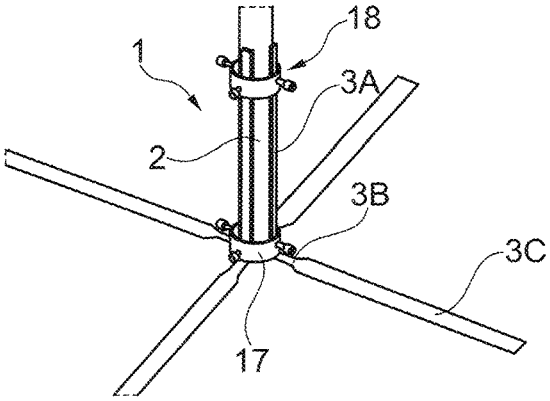
Figure 12:
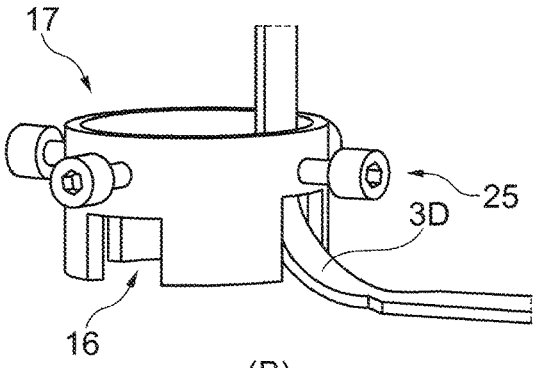
Figure 12:
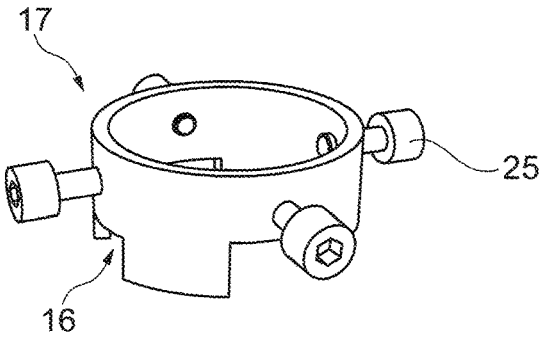

FIG. 12 shows a support base 1 for a pole-like element 2 (FIG. 12(A)). The support base 1 comprises two rings 17, 18, wherein each ring 17, 18 includes radially opposing bolts 25 operable to be screwed inwardly towards a centre of the rings 17, 18. In particular, ring 17 has a number of cut-outs 16 formed such that the right-angled part 3B of each L-shaped element 3 can pass through it while the ring 17 can stand on the ground (FIGS. 12(A)-(B)).

Figure 13:
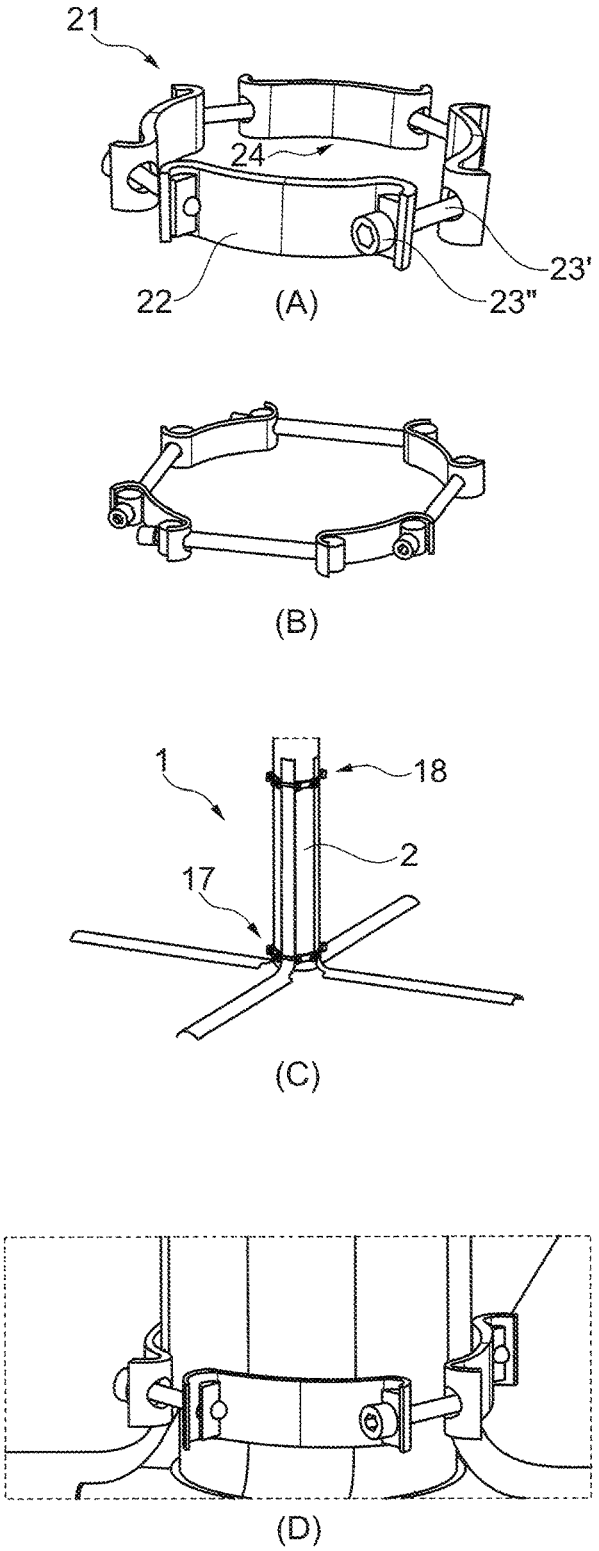
FIG. 13: A support base with two ring members, wherein each ring member is a clamp.

FIG. 13 shows a support base 1 for a pole-like element 2 (FIGS. 13(C)-(D)). The support base 1 comprises two rings 17, 18, wherein each ring 17, 18 is a clamp 21 including four clamping elements 22, which are fastened together and can be loosened/tightened by means of bolts 23' and barrel nuts 23". Also, each clamping element 22 includes a friction-generating portion 24 arranged to face inwardly towards a centre of the clamp 21.

Figure 14:
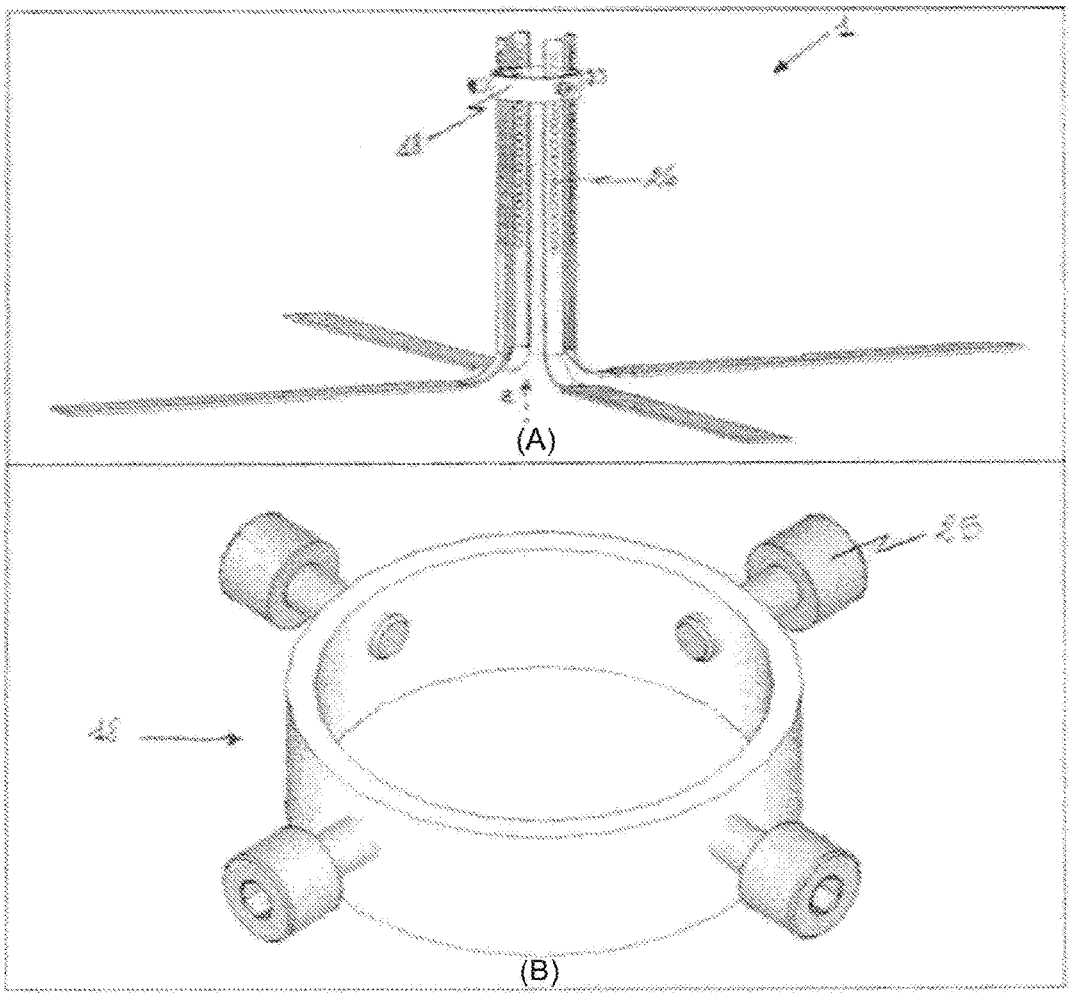
FIG. 14: A kit of parts and a support base with a ring member comprising radial opposing bolts.

FIG. 14 shows a support base 1 for a pole-like element 2 (not shown in FIG. 14). While the ring 18 includes radially opposing bolts 25 operable to be screwed inwardly towards a centre of the ring 18, each upright part 3A includes one or more indentations 26 along the longitudinal axis z for engaging with the bolts 25.

Figure 15:
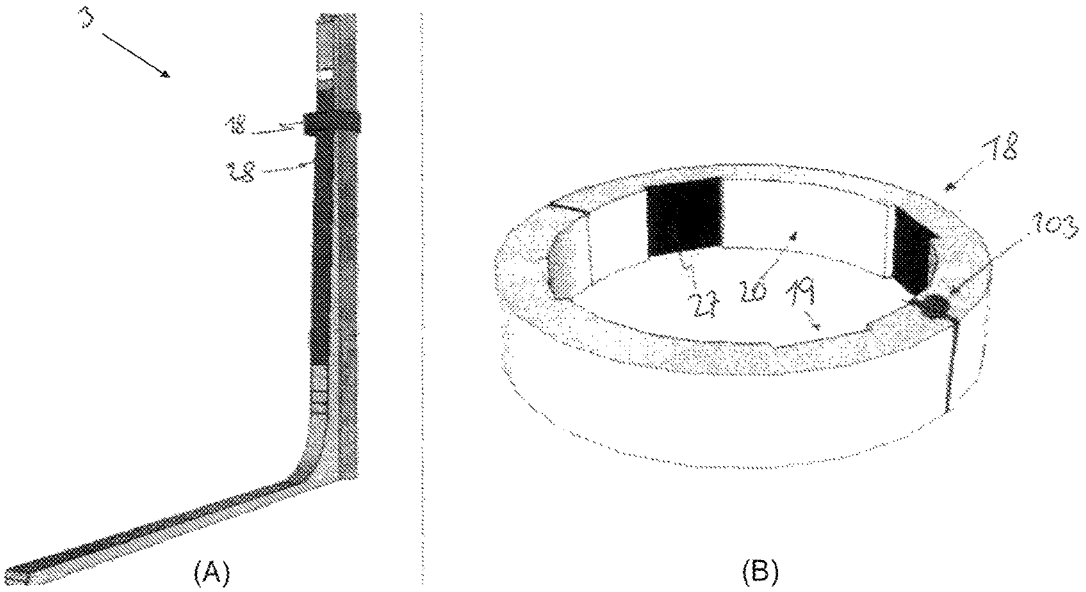
FIG. 15: A ring member comprising recesses and magnets.

FIG. 15 shows a ring 18 comprising four recesses 19 on its inner face 20. While a magnet 27 is placed at the bottom of each recess 19, a contact portion 28 of the upright parts 3A of the L-shaped elements 3 are made of a magnetic material. Also, the ring includes a hinge 103 for opening and closing the ring member 18.

Figure 16:
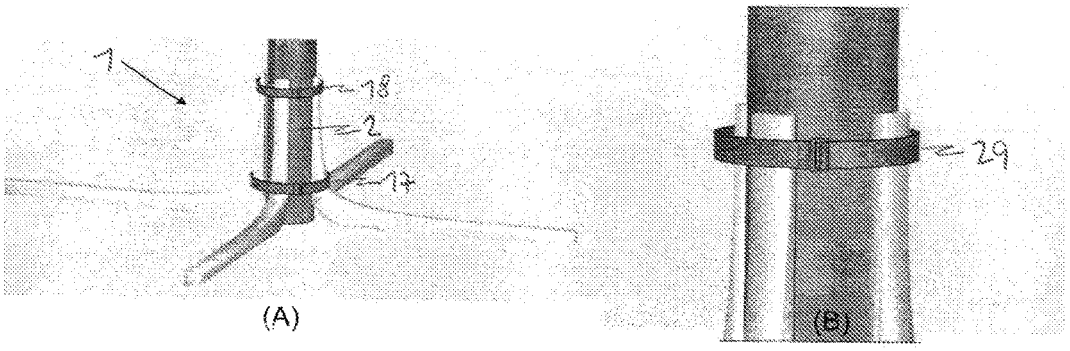
FIG. 16: A support base with two ring members, wherein each ring member is a strap.

FIG. 16 shows a support base 1 for a pole-like element 2. The support base 1 comprises first and second holding means 17, 18, each being a strap 29.

Figure 17:
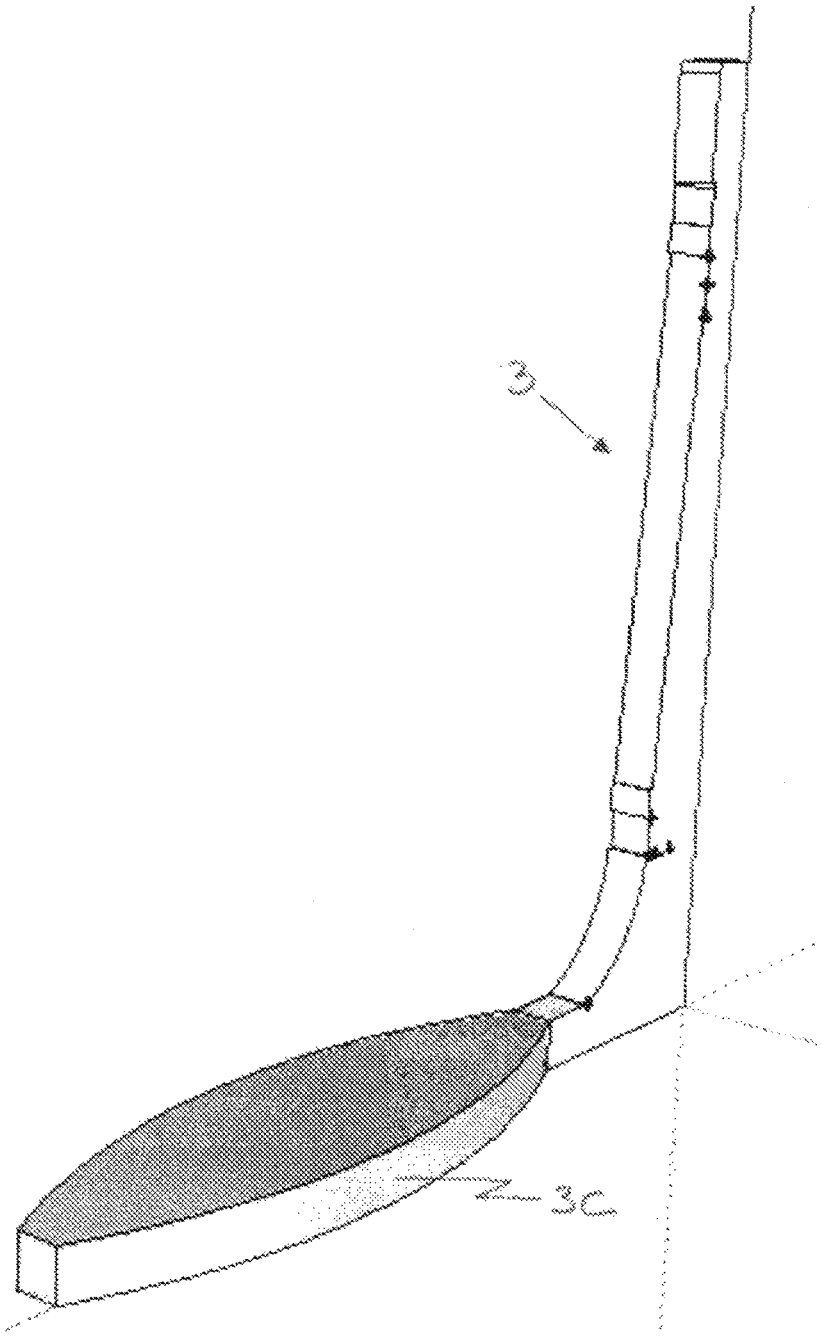
FIG. 17: An L-shaped element with a foot part comprising a blade-shaped weight.

FIG. 17 shows an L-shaped element 3 whose foot part 3C is leaf-shaped and is solid. The foot part 3C may be made of a material comprising sand, cement, aggregate, and combinations thereof.

Figure 18:
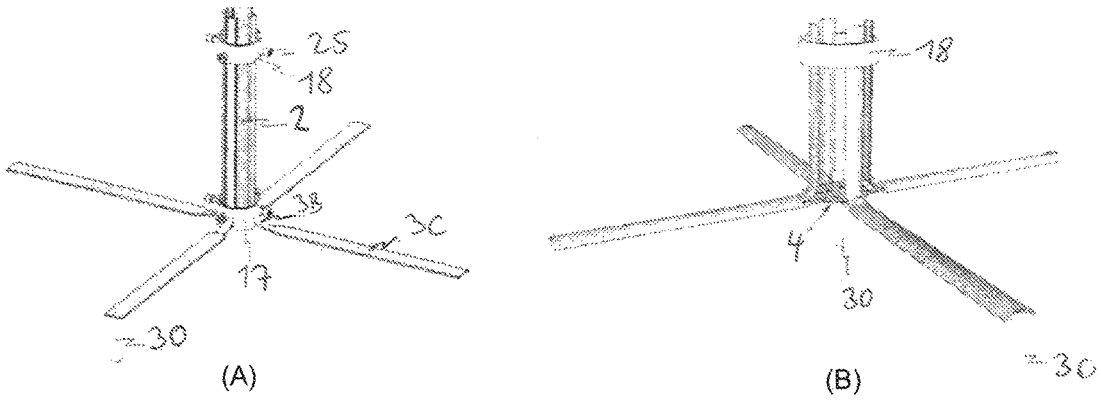
FIG. 18: A support base comprising ground spikes.

FIG. 18 shows the support bases 1 of FIG. 12 (FIG. 18(A)) and FIG. 10 (FIG. 18(B)), wherein the L-shaped elements 3 and the base element 4 comprise a ground spike 30 underneath.

Figure 19:
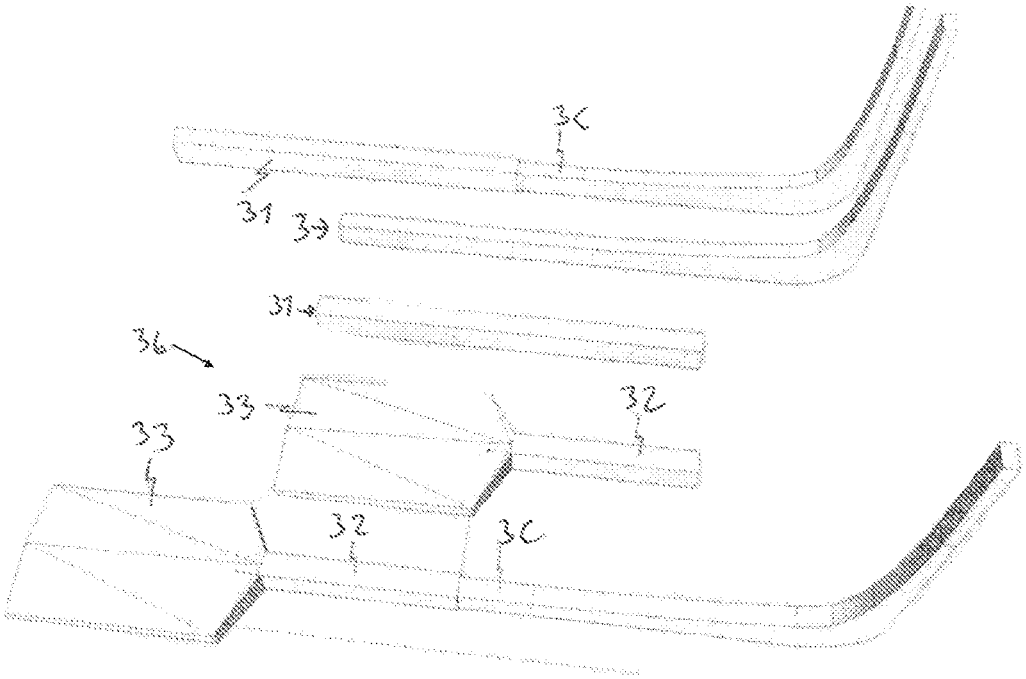
FIG. 19: Extension elements and terminal elements.

FIG. 19 shows (at the top) an extension element 31 connected to the foot part 3C of an L-shaped element 3. FIG. 19 shows (at the bottom) an element, which comprises a shaft part 32 and a blade part 33, connected to the foot part 3C of an L-shaped element 3.

Figure 20:
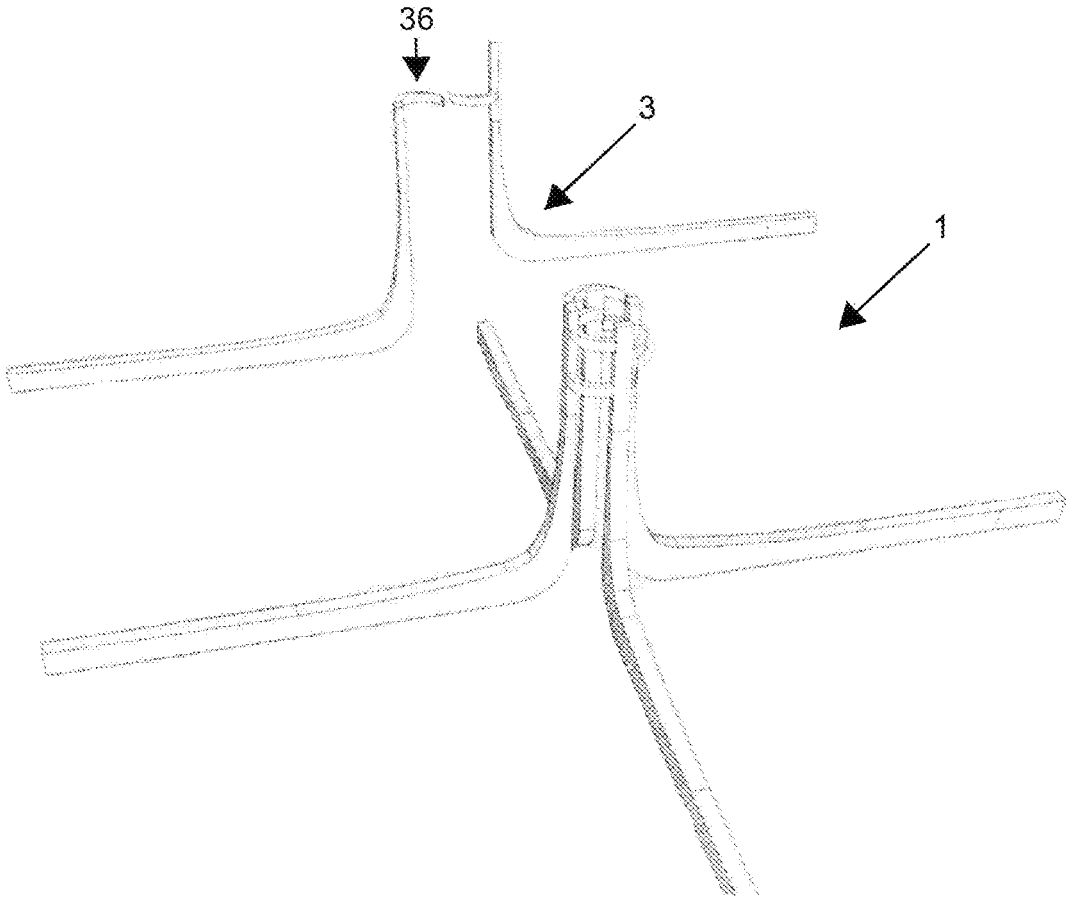
FIG. 20: A support base where each L-shaped element is provided with integrated fastening means.

FIG. 20 shows a support base 1 where each L-shaped element 3 is provided with integrated fastening means 36 such that, when the L-shaped elements 3 are brought into close proximity, fastening means 36 on one L-shaped element 3 engage with an adjacent L-shaped element 3, thus creating a stable and fixed support base 1. The ring member 18 is in effect divided into a number of segments, wherein each segment is integrated in an L-shaped element 3.

Figure 21:
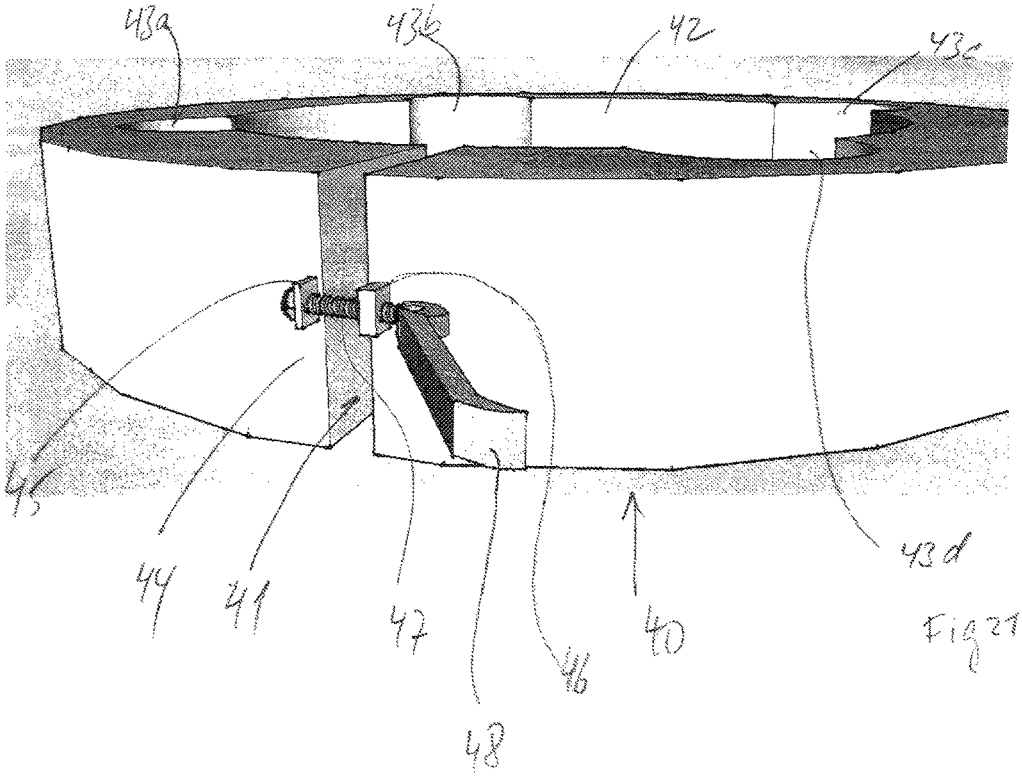
FIG. 21: The first holding means in the shape of a ring member.

In FIG. 21 is illustrated the first holding means in the shape of a ring member 40. The ring member is provided with a slit 41 such that the diameter of the inner opening 42 may be enlarged in order to release the engagement between the ring member 40 and the upright portions of the L-shaped members (not illustrated). As is the case with most of the other embodiments relating to the first fastening means and particularly in the shape of a ring member the ring member is provided with guide grooves 43*a*, 43*b*, 43*c*, 43*d*. The guide grooves serve to guide and hold the upright portion of the L-shaped members. Friction enhancing means are provided, in order to mutually increase the friction between the upright part of the L-shaped members and the ring.

In order to firmly affix the ring member 40 to the pole and the upright portions the slit 41 may be closed by a releasable closing mechanism 44. In this embodiment the closing mechanism 44 incorporates two flanges 45, 46. The flanges 45, 46 are provided with a thread such that a threaded axle 47 can be arranged in the threaded holes in the flanges 45, 46. By rotating the handle 48 the size of the slit may be enlarged or diminished. In this manner the ring shaped member 40 may be tightened around the pole and the upstanding upright parts of the L-shaped members. Many other manners of tightening/closing and opening the slit may also be implemented.

Figure 22:
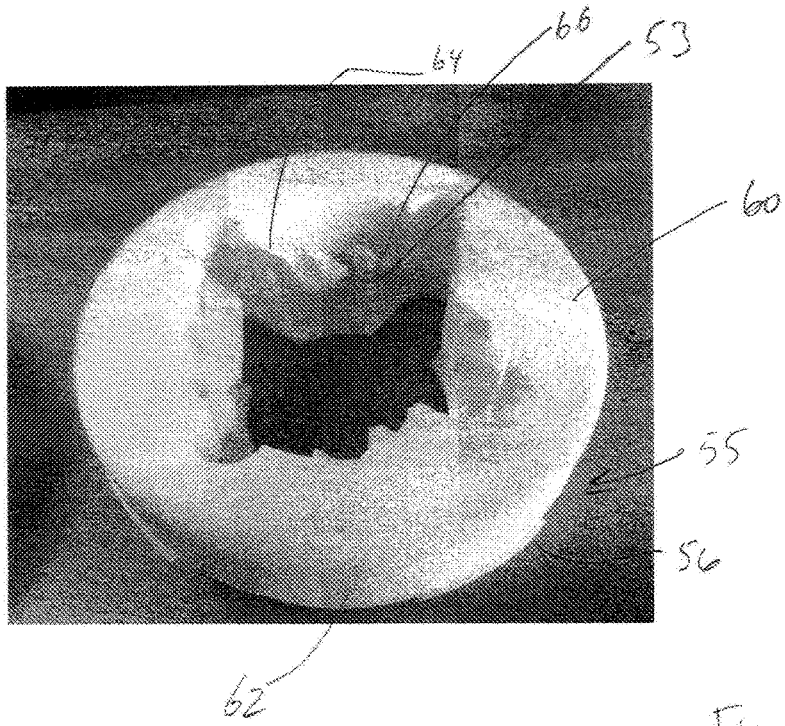
FIG. 22: The assembled ring.
Figure 23:
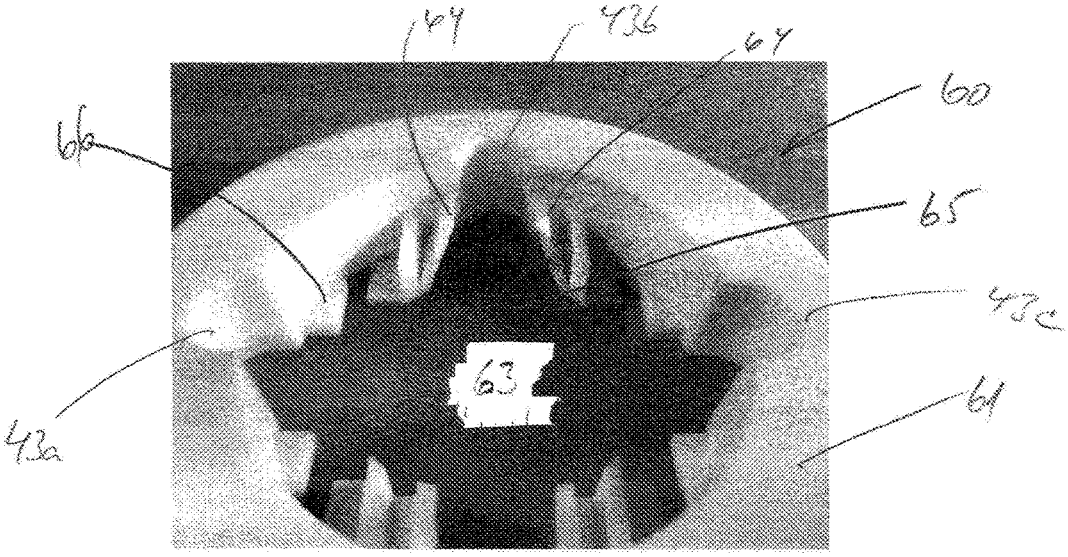
FIG. 23: The over-cup.

Turning to a further embodiment of the invention this will be illustrated with respect to the FIGS. 22-27. In this embodiment the first fastening means is also in the shape of a ring, but in this embodiment the first fastening member 18 comprises two parts as will be explained with reference to the FIGS. 22-24. In FIG. 22 the assembled ring is illustrated and in FIG. 23 is illustrated the over-cup and in FIG. 24 the under-cup. Starting with the under-cup illustrated in FIG. 24 the under-cup comprises a bottom plate 50. Along the outer periphery of the bottom plate 50 is provided a peripheral wall 51 arranged substantially orthogonal to the bottom plate 50. Furthermore, in the bottom plate 50 openings are made for the guide grooves 43*a*, 43*b*, 43*c* and 43*d*. Also upstanding from the bottom plate 50 substantially parallel to the peripheral wall 51 are release tabs 52. The release tabs are arranged adjacent the guide grooves 43*c* on either side of the guide groove and the release tabs 52 are furthermore biased towards each other. In this embodiment the under ring 55 is made from injection moulded plastic and as such the release tabs 52 are moulded slightly leaning towards each other across the guide groove in order to create a degree of biasing.

Also provided upstanding from the bottom plate 50 of the under-cup 55 is a number of holding legs 53. At a distal end of the holding legs 53 is provided a hook.

The under-cup is further provided with biased means. In this embodiment the biased means are in the shape of injection moulded biased plastic leaf springs 56 arranged along the outer periphery of the peripheral wall 51. Alternatively, normal helical springs may be provided, and for this purpose the bottom plate 50 is provided with spring towers 57 suitable to accommodate and guide a helical spring arranged in parallel to the peripheral wall 51.

Turning to FIG. 23 the over-cup 60 is illustrated. The over-cup has a top plate 61 and a peripheral wall arranged along the outer perimeter of said top wall. The outer wall may be seen in FIG. 22 reference number 62.

A second central aperture having a second diameter larger than the diameter of the first diameter through which the pole is supposed to pass is provided in said top plate 61. The over-cup 60 is also provided with guide grooves 43*a*-43*d*.

Adjacent to at least one guide groove is provided flexible engagement means 64 projecting into the guide grooves. The engagement means 64 are suitable to engage the corrugations, serrations, teeth, ridges or grooves provided on the side faces of the upright part of the L-shaped members such that as the ring member 60 as assembled in FIG. 22 slides down the upright parts of the L-shaped members the engagement means 64 will click or be deviated as it passes each corrugation, serration or tooth on the side faces of the L-shaped members.

Once the ring 60 has been lowered sufficiently down the tapered upright part of the L-shaped members the L-shaped members will be in firm engagement with the pole (not illustrated) and the engagement means 64 will be locked against a corrugations, serration, teeth, ridges or grooves provided in the side faces of the L-shaped member. In this manner a secure and stable connection is created between the pole and pole basis.

In order to release the ring shaped member 60 from the engagement with the L-shaped upright part the over-cup and the under-cup are further squeezed together, whereby the release tabs slide upwards on an angular face 65 of the engagement means 64. As the engagement means are in very close proximity to the side faces of the upright part of the L-shaped member, the release tabs will cause the engagement means 64 to flex away from the L-shaped members thereby releasing the grip of the ring against the L-shaped members making it possible to lift the ring shaped member further up until it disengages completely from the tapered L-shaped members.

Figure 24:
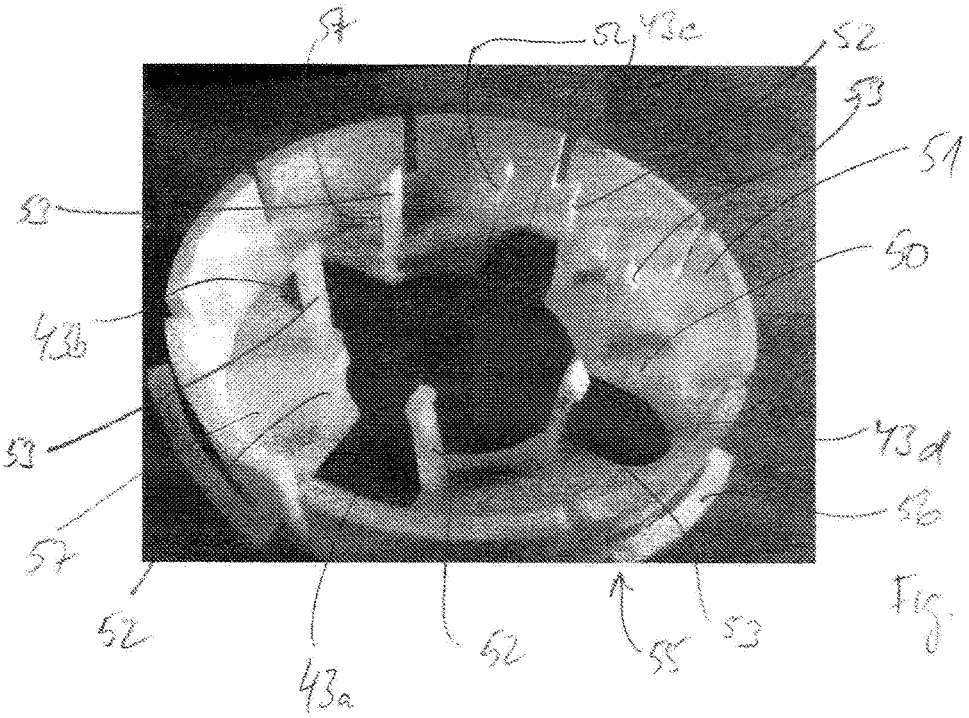
FIG. 24: The under-cup.

The holding legs 53 described with reference to FIG. 24 provided on the under-cup will engage flanges 66 provided on the over-cup such that the hook shaped member will hinder the over and under-cup in disengaging, but will allow the over-cup and under-cup to be further depressed, i.e. such that the distance between the top plate 61 of the over-cup and the bottom 50 of the under-cup will come closer to each other. Bringing the two closer will cause the release tabs 52 to slide upwards along the face 65 of the engagement means 64 thereby flexing the engaging means 64 as already described above.

Figure 25:
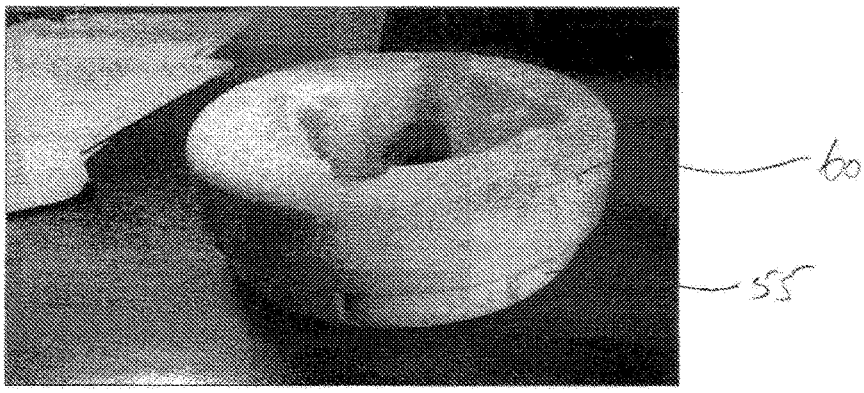
FIG. 25: The assembled fastening means.
Figure 26:
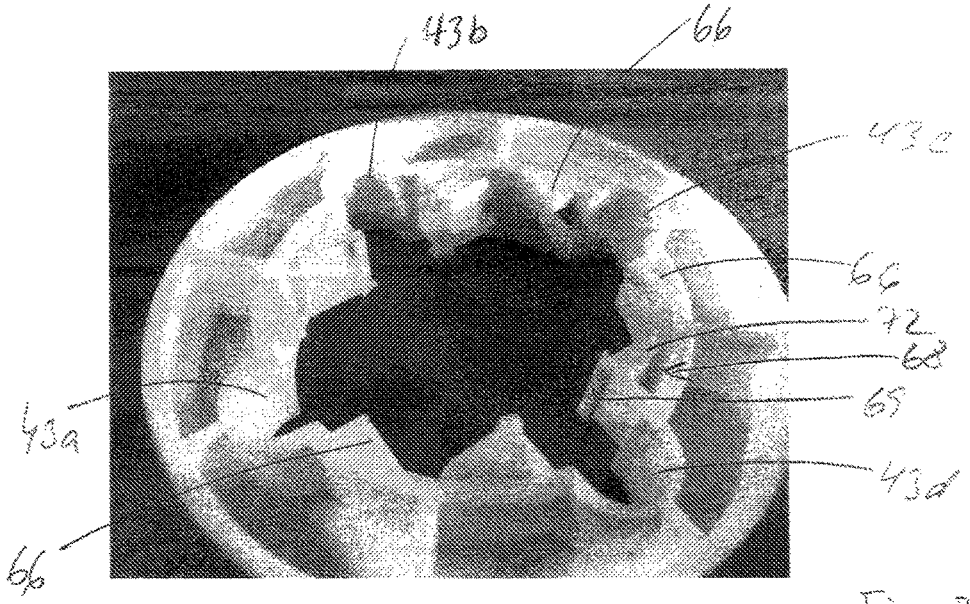
FIG. 26: The over-cup where the engagement means has a distinct engagement section.
Figure 27:
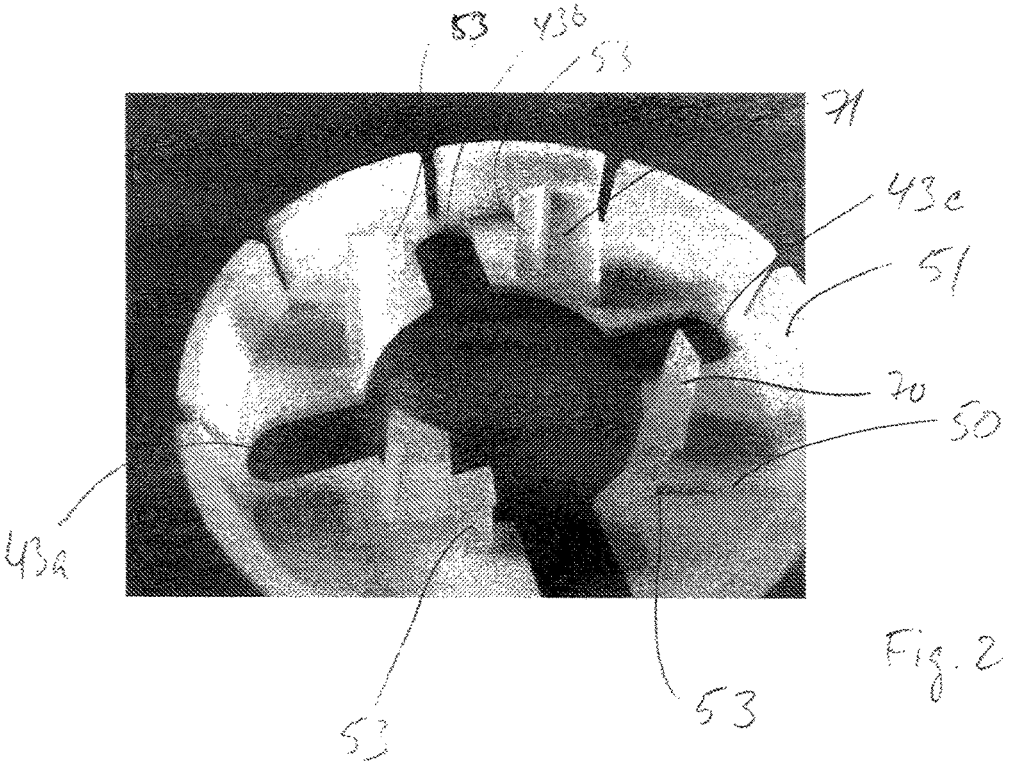
FIG. 27: The under-cup.

In FIG. 25-27 is disclosed an alternative embodiment but working on the same principle that a displacement vertically or parallel to the pole's longitudinal direction of an over-cup and an under-cup will create a release mechanism. Whereas the release mechanism described above with reference to FIGS. 22-24 was created by a vertical movement creating a sideways flex of the engagement means 52 the alternative embodiment illustrated in FIGS. 25-27 creates the release by swinging engagement members out of engagement with the serrations on the upright part of the L-shaped members. In order to ease the explanation of the embodiment like features will be denoted with the same reference numbers as was used above with respect to the first embodiment described with reference to FIGS. 22-24.

In FIG. 25 the assembled fastening means is illustrated having an under-cup 55 and an over-cup 60. As was the case in the first embodiment the under-cup 55 illustrated with reference to FIG. 27 has a bottom plate 50 where an outer periphery is provided with an upstanding peripheral wall 51. Holding leg 53 provided with hook means are also provided for engagement with flanges 66 provided on the over-cup.

On FIG. 26 the over-cup 60 is illustrated where the engagement means 68 has a distinct engagement section 69. The engagement section 69 is designed to actively engage the serrations, teeth or corrugations or the like provided on the side faces of the L-shape members. In the under-cup is provided deflection blocks 70. The deflection blocks are dimensioned and provided with an oblique surface 71 such that as the over-cup and the under-cup are assembled the oblique surface 71 will engage the release section 72 of the fastening means 68 thereby swinging the engagement section 69 out of engagement with the serrations, corrugations or other friction enhancing properties on the side face of the L-shaped members. The action between the oblique surface 71 and the release section 72 occurs as the under-cup and over-cup are squeezed together in the same fashion as the embodiment of the invention described with reference to FIGS. 22-24.

The invention claimed is:

1. A kit of parts for building a support base for in use supporting a pole-like element in an upright position, wherein the kit of parts comprises at least three substantially L-shaped elements, each L-shaped element having three integral sections; an upright part suitable to extend along a body portion of the pole-like element in a direction parallel to a longitudinal axis of the pole-like element and a foot part connected to said upright part by means of a right-angled part, such that the foot part in use extends outwardly from a lowermost portion of the pole-like element, wherein the kit of parts further comprises a first holding means for holding and urging each L-shaped element towards the pole-like element, wherein a base element having a centre portion to be placed underneath the pole-like element is provided, the base element including either:

- a number of channels extending radially from said centre portion of the base element, wherein each channel is formed such as to accommodate at least a portion of the right-angled part of a L-shaped element; or
- a number of projections extending radially from said centre portion of the base element, wherein each projection comprises at a free-end a first element of a fastening means for engaging with a second element of the fastening means, said second element being arranged in an opening in the right-angled part of each L-shaped element.

2. The kit of parts (100) according to claim 1, wherein each channel has inwardly-tapered lateral sides and each portion of the right-angled part of an L-shaped element has a cross-section with a shape and dimension suitable to engage with the channel.

3. The kit of parts according to claim 1, wherein the first holding means is a first ring member adapted to encircle and to hold the right-angled parts of the L-shaped elements in proximity of the pole-like element.

4. The kit of parts according to claim 1, wherein each upright part of each L-shaped element gradually tapers towards the free-end of the upright part.

5. The kit of parts according to claim 1, wherein the L-shaped elements has a first side face suitable to contact the pole-like element, and an opposite second side face, facing away from the first side face intended for contacting the pole-like element, where the upright part of the L-shaped element tapers from a free distal end towards the right-angled part, and where the second side face is provided with serrations or ridges or grooves or teeth or barbs.

6. The kit of parts according to claim 1, wherein the first holding means is in the shape of a ring, where said ring is dimensioned to be placed over the at least three L-shaped members in use, and where said ring is provided with a number of guide grooves corresponding to the number of L-shaped elements, such that each L-shaped element will slidably and releasably be held by said guide groove.

7. The kit of parts according to claim 5, wherein the ring is provided with a slit allowing the ring to expand its diameter, and where means for releasably closing or partly closing said slit is provided.

8. Kit of parts according to claim 6, wherein the L-shaped elements on the upright part is provided with at least three side faces, a first side face suitable to come into contact with the pole-like element, and two side faces, a second and a third side face extending away from said first side face, where said second and third side faces are provided with corrugations, barbs, serrations, teeth, ridges or grooves, and where the first holding means comprises:

a ring-shaped under-cup, said under-cup having a bottom plate where a central aperture having a first diameter is provided in said bottom plate, and where a peripheral wall is provided around an outer perimeter of said bottom plate, said central aperture being provided with at least three guide grooves, and that adjacent at least one guide groove, two release taps are projecting up from the bottom plate in the same direction as the peripheral wall, such that one release tap is arranged on either side of the guide groove, where said release taps are biased towards each other, and where further one or more holding legs are provided on said bottom plate extending in the same direction as the peripheral wall, where said holding legs in a distal end is provided with hook means;

an over-cup, said over-cup having a top plate and a peripheral wall arranged along the outer perimeter of said top plate, where a second central aperture having a second diameter is provided in said top plate, said second diameter being larger than the first diameter of said under-cup, said second central aperture being provided with at least three guide grooves, and where at least one guide groove is provided with flexible engagement means projecting into the guide groove, said engagement means suitable to engage the corrugations, barbs, serrations, teeth, ridges or grooves provided on the upright part of the L-shaped elements, when the L-shaped elements are positioned in the guide grooves, and where one or more flanges are provided extending into the second central aperture, such that when the under-cup is assembled with the over-cup, the release taps are positioned in contact with the engagement means on a side of the engagement means facing the guide grooves, and where the hook means engages the one or more flanges, thereby locking the under-cup and over-cup together, only allowing the under-cup and over-cup to be further compressed, and where biasing means are provided between said over and under-cups, biasing the under-cup away from said over-cup.

9. A releasably locking ring for use in a kit of parts according to claim 1, said ring comprising:

a ring-shaped under-cup, said under-cup having a bottom plate where a central aperture having a first diameter is provided in said bottom plate, and where a peripheral wall is provided around an outer perimeter of said bottom plate, said central aperture being provided with at least three guide grooves, and that adjacent at least one guide groove two release taps are projecting up from the bottom plate in the same direction as the peripheral wall, such that one release tap is arranged on either side of the guide groove, where said release taps are biased towards each other, and where further one or more holding legs are provided on said bottom plate extending in the same direction as the peripheral wall, where said holding legs in a distal end is provided with hook means;

an over-cup, said over-cup having a top plate and a peripheral wall arranged along the outer perimeter of said top plate, where a second central aperture having a second diameter is provided in said top plate, said second diameter being larger than the first diameter of said under-cup, said second central aperture being provided with at least three guide grooves, and where at least one guide groove is provided with flexible engagement means projecting into the guide groove, said engagement means suitable to engage the corrugations, barbs, serrations, teeth, ridges or grooves provided on the upright part of the L-shaped elements, when the L-shaped elements are positioned in the guide grooves, and where one or more flanges are provided extending into the second central aperture, such that when the under-cup is assembled with the over-cup, the release taps are positioned in contact with the engagement means on a side of the engagement means facing the guide grooves, and where the hook means engages the one or more flanges, thereby locking the under-cup and over-cup together, only allowing the under-cup and over-cup to be further compressed, and where biasing means are provided between said over and under-cups, biasing the under-cup away from said over-cup.

10. The kit of parts according to claim 1, wherein the projections are flanges extending from the channels into the openings in the L-shaped elements.

11. A kit of parts for building a support base for in use supporting a pole-like element in an upright position, wherein the kit of parts comprises at least three substantially L-shaped elements, each L-shaped element having three integral sections; an upright part suitable to extend along a body portion of the pole-like element in a direction parallel to a longitudinal axis of the pole-like element and a foot part connected to said upright part by means of a right-angled part, such that the foot part in use extends outwardly from a lowermost portion of the pole-like element, wherein the kit of parts further comprises a first holding means for holding and urging each L-shaped element towards the pole-like element, wherein a base element having a centre portion to be placed underneath the pole-like element is provided, the base element including a number of channels extending radially from said centre portion of the base element, wherein each channel is formed such as to accommodate at least a portion of the right-angled part of a L-shaped element.

12. A kit of parts for building a support base for in use supporting a pole-like element in an upright position, wherein the kit of parts comprises at least three substantially L-shaped elements, each L-shaped element having three integral sections; an upright part suitable to extend along a body portion of the pole-like element in a direction parallel to a longitudinal axis of the pole-like element and a foot part connected to said upright part by means of a right-angled part, such that the foot part in use extends outwardly from a lowermost portion of the pole-like element, wherein the kit of parts further comprises a first holding means for holding and urging each L-shaped element towards the pole-like element, wherein a base element having a centre portion to be placed underneath the pole-like element is provided, the base element including a number of projections extending radially from said centre portion of the base element, wherein each projection comprises at a free-end a first element of a fastening means for engaging with a second element of the fastening means, said second element being arranged at the right-angled part of each L-shaped element.

* * * * *